United States Patent [19]

Yamashita et al.

[11] Patent Number: 4,788,119

[45] Date of Patent: Nov. 29, 1988

[54] ELECTROPHOTOGRAPHIC PHOTOSENSITIVE MEMBER CONTAINING A DISAZO PIGMENT

[75] Inventors: Masataka Yamashita, Kawasaki; Hajime Miyazaki, Yokohama; Takao Takiguchi, Tokyo; Masakazu Matsumoto, Yokohama; Masaaki Hiro, Kanagawa; Shozo Ishikawa, Yokohama, all of Japan

[73] Assignee: Canon Kabushiki Kaisha, Tokyo, Japan

[21] Appl. No.: 867,140

[22] Filed: May 27, 1986

[30] Foreign Application Priority Data

May 29, 1985 [JP] Japan ..... 60-114000

[51] Int. Cl.[4] ..... G03G 5/06

[52] U.S. Cl. ..... 430/58; 430/77; 430/79

[58] Field of Search ..... 430/59, 58, 76, 77, 430/78, 79

[56] References Cited

U.S. PATENT DOCUMENTS

| | | | |
|---|---|---|---|
| 4,356,243 | 10/1982 | Ishikawa et al. | 430/58 |
| 4,471,040 | 9/1984 | Katagiri et al. | 430/77 |
| 4,582,771 | 4/1986 | Ohta | 430/76 |
| 4,612,271 | 9/1986 | Makino et al. | 430/76 |

*Primary Examiner*—John L. Goodrow

*Attorney, Agent, or Firm*—Fitzpatrick, Cella, Harper & Scinto

[57] ABSTRACT

The invention provides an electrophotographic photosensitive member having an improved sensitivity and an improved potential stability when repeatedly copied by using a photosensitive layer containing a disazo pigment having a specific molecular structure.

7 Claims, No Drawings

ELECTROPHOTOGRAPHIC PHOTOSENSITIVE MEMBER CONTAINING A DISAZO PIGMENT

BACKGROUND OF THE INVENTION

1. Field of the Invention

This invention relates to an electrophotographic photosensitive member, and more particularly to an electrophotographic photosensitive member using a specific azo-based pigment.

2. Related Background Art

Organic pigments or dyes having a photoconductivity can be more readily synthesized than inorganic materials and have more variations from which compounds having a photoconductivity in an appropriate wavelength region can be selected. Thus, many photoconductive organic pigments and dyes have been so far proposed. As disclosed in, for example, U.S. Pat. Nos. 4,123,270; 4,247,614; 4,251,613; 4,251,614; 4,256,821; 4,260,672; 4,268,596; 4,278,747; 4,293,628, etc., electrophotographic photosensitive members using disazo pigments having a photoconductivity as a charge-generating material in a photosensitive layer, which is functionally separated into a charge generation layer and a charge transport layer, are known. Electrophotographic photosensitive members using such an organic photoconductive material can be produced by coating upon appropriate selection of a binder, and thus can be provided at a low cost with a very high productivity, and furthermore have an advantage of controlling a photosensitive wavelength resion as desired, upon selection of an organic pigment.

Photosensitive members having an organic pigment on an electroconductive layer so far known include:

(1) the one provided with a layer of a pigment as dispersed in an insulating binder on an electroconductive layer, as disclosed in Japanese Patent Publication No. 1667/1997 with the title "Electrophotographic plate;

(2) the one provided with layer of a pigment as dispersed in a charge transport material or a charge transport medium comprising a charge transport material and an insulating binder, which may be a charge transport material by itself, as disclosed in Japanese Patent Application Laid-open No. 30328/1972 with the title "Electrophotographic plate" and Japanese Patent Application Laid-open No. 18545/1972 with the title "Electrophotographic process";

(3) the one comprising an electroconductive layer, a charge generation layer containing an organic pigment and a charge transport layer, as disclosed in Japanese Patent Application Laid-open No. 105537/1974 with the title "Electrophotographic plate";

(4) the one provided with a charge transfer complex containing an organic pigment, as shown in Japanese Patent Application Laid-open No. 91648/1974 with the title "Photoconductive member"; and (5) others.

Among the photoconductive azo pigments used in such electrophotographic photosensitive members, disazo pigments having a benzoxazole skeleton, as disclosed in Japanese Patent Applications Laid-open Nos. 116039/1981 (=U.S. Pat. No. 4,356,243); 63,541/1982; 63542/1982 and 63549/1982; disazo pigments having an benzthiazole skeleton, as disclosed in Japanese Patent Application Laid-open No. 63537/1982; and disazo pigments having a benzimidazole skeleton, as disclosed in Japanese Patent Applications Laid-open nos. 49,950/1982; 78,542/1982; and 90,632/1982 are said to have distinguished characteristics, but are still keenly required to meet higher speed of a copying machine using a photosensitive member or lower cost thereof, which can be attained with respect to the lens, light source, power source for the light source, etc. by higher sensitization of the photosensitive member. In these circumstances, the photosensitive members are still now required for much higher sensitization.

SUMMARY OF THE INVENTION

One object of the present invention is to provide an electrophotographic photosensitive member having a higher sensitivity than the conventional ones.

Another object of the present invention is to provide an electrophotographic photosensitive member having a stable dark portion potential and a stable light portion potential even in a continuous copying operation.

These objects can be attained with an electrophotographic photosensitive member having a photosensitive layer on a support, characterized in that the photosensitive layer contains a disazo pigment represented by the following general formula [I]:

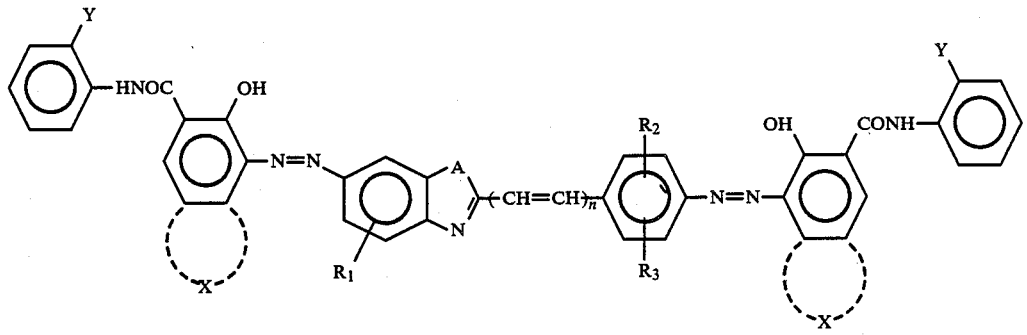

[I]

wherein X, Y, A, $R_1$, $R_2$, $R_3$ and n are defined below.

DESCRIPTION OF THE PREFERRED EMBODIMENTS

In the above general formula [I], X represents a residue necessary for forming a polycyclic aromatic ring such as a naphthalene ring, anthracene ring, etc., which may have a substituent, or a hetero ring such as a carbazole ring, a benzcarbazole ring, a dibenzofuran ring, a benznaphthofuran ring, a diphenylene sulfide ring, etc., which may have a substituent, by condensation or fusion with the benzene ring having the hydroxyl group shown in the formula; Y represents an electron-attractive group, including a halogen atom such as fluorine, chlorine, bromine, iodine, etc.; or nitro, cyano, trifluoromethyl, acetyl, etc; A represents —O—, —S—, or

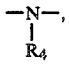

where $R_4$ represents a hydrogen atom, an alkyl group such as methyl, ethyl, propyl, butyl, etc., which may have a substituent, an aralkyl group such as benzyl, phenethyl, naphthylmethyl, etc. which may have a substituent, or an aryl group such as phenyl, naphthyl, etc. which may have a substituent; $R_1$, $R_2$, and $R_3$ each represent a hydrogen atom, a halogen atom such as fluorine, chlorine, bromine, iodine, etc., an alkyl group such as methyl, ethyl, propyl, butyl, etc., which may have a substituent, or an alkoxy group such as methoxy, ethoxy, propoxy, butoxy, etc., which may have a substituent; and n is 0 or 1.

The disazo pigment of general formula (I) for use in the present invention is characterized by a benzoxazole, benzthiazole, or benzimidazole skeleton; an electron attractive group as a substituent at the anilide structure portion of the coupler residue; and its position being ortho with respect to —CONH—. One reason for attaining the higher sensitivity by virtue of these characteristics seems to be that the flatness of the coupler residue is increased by interaction between the electron attractive group and H of —CONH—, and consequently the carrier generation ability of the disazo pigment and the carrier transport ability in the photosensitive layer are increased. Another reason seems to be that the electronic state of the skeleton and the structure of the coupler portion are in a peculiarly well balanced state with respect to the generation, transport, etc. of the carriers. Particularly preferable coupler residue of the disazo pigment of general formula [I] is 3-hydroxy-2-naphthalene-0-chloroanilide.

Stable light portion potential and stable dark portion potential even in a continuous copying operation seem to be the effects obtained in connection to the drastic improvement of carrier transportability within the photosensitive layer containing the disazo pigment.

Specific embodiments of the disazo pigment of general formula [I] for use in the present invention can be shown by the following general formulae [II] to [XV] and include compounds with the following pigment numbers.

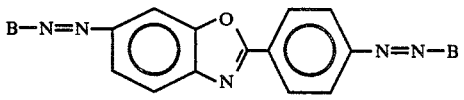

[II]

wherein B is:

| Pigment No. | |
|---|---|
| 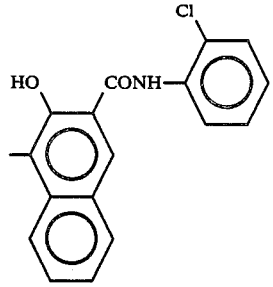 | (1) |
| 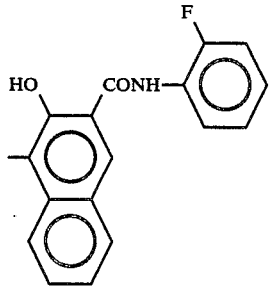 | (2) |
| 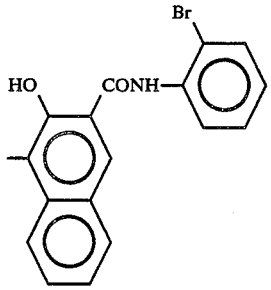 | (3) |
| 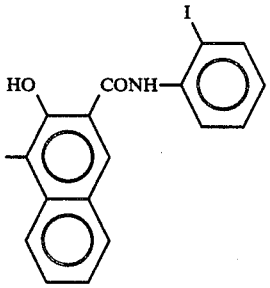 | (4) |
| 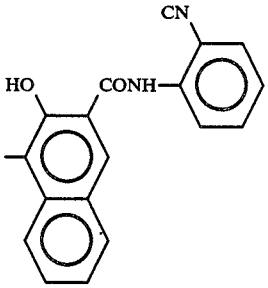 | (5) |

-continued
| Pigment No. | |
|---|---|
| (6) | 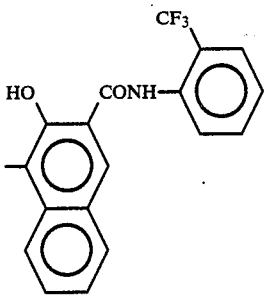 |
| (7) | 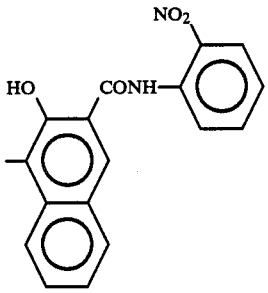 |
| (8) | 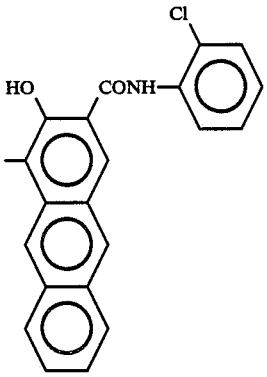 |
| (9) | 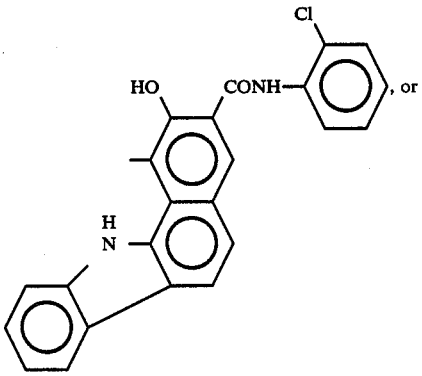 , or |
-continued
| Pigment No. | |
|---|---|
| (10) | 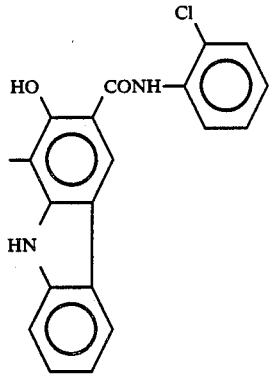 |
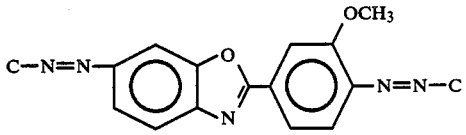
[III]
wherein C is:
| Pigment No. | |
|---|---|
| (11) | 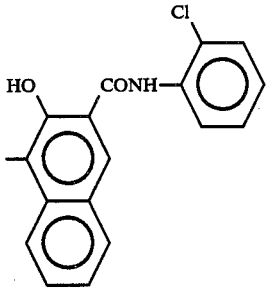 |
| (12) | 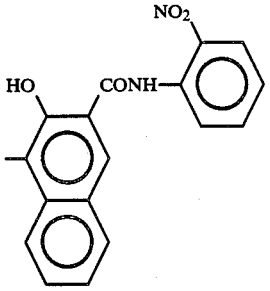 |
| (13) | 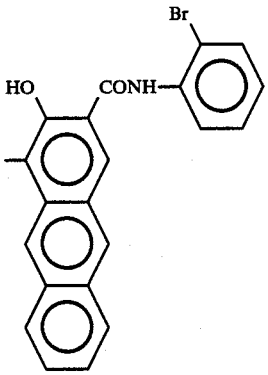 |

-continued
Pigment No.
(14)
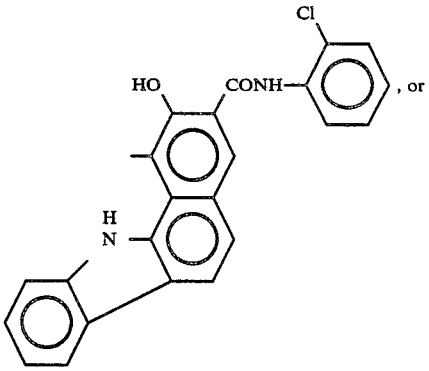
, or
(15)
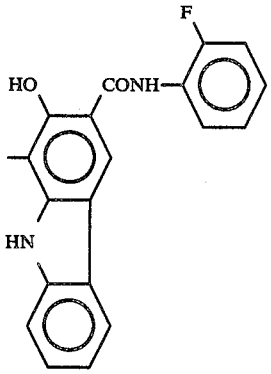
[IV]
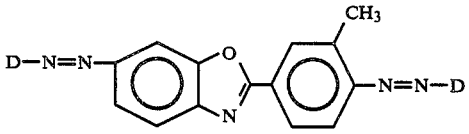
wherein D is:
Pigment No.
(16)
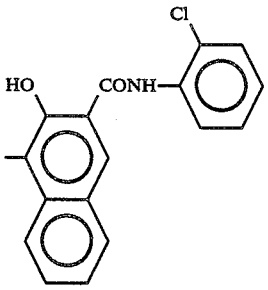
-continued
Pigment No.
(17)
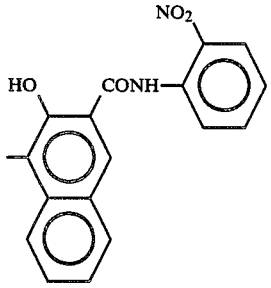
(18)
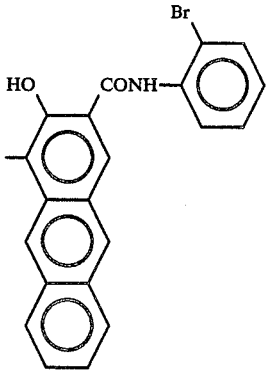
(19)
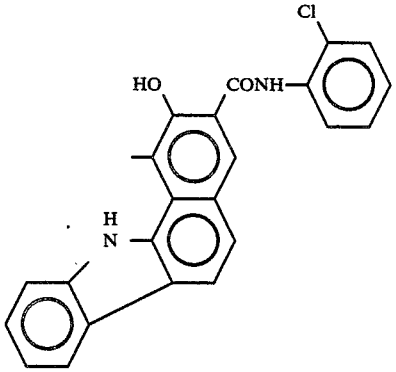
, or
(20)
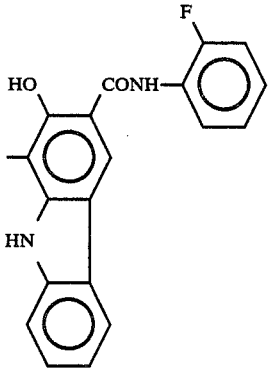
[V]
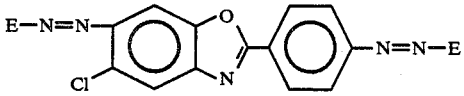
wherein E is:

| | Pigment No. |
|---|---|
| 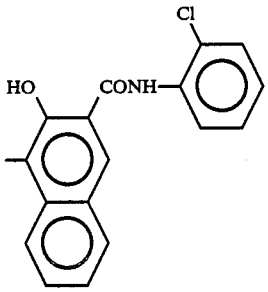 | (21) |
| 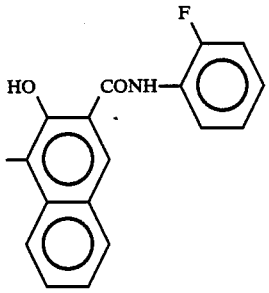 | (22) |
| 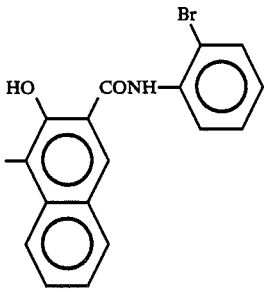 | (23) |
| 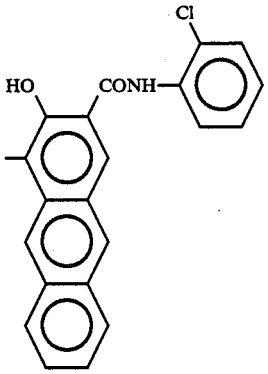 | (24) |
-continued
| | Pigment No. |
|---|---|
| 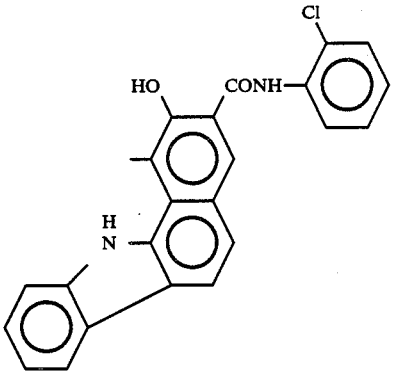 | (25) |
| 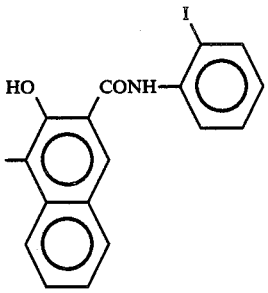 | (26) |
| 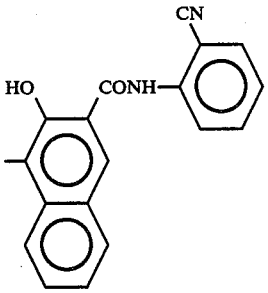 | (27) |
| 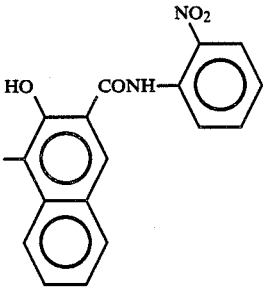 | (28) |
| 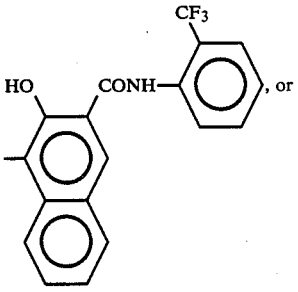 , or | (29) |

-continued
| | Pigment No. |
|---|---|
| 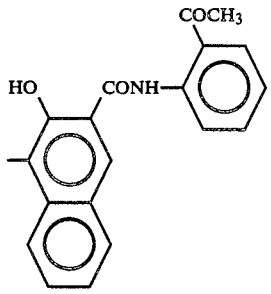 | (30) |
[VI]
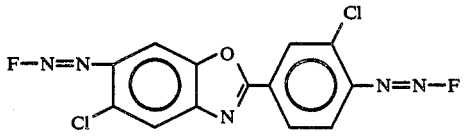
wherein F is:
| | Pigment No. |
|---|---|
| 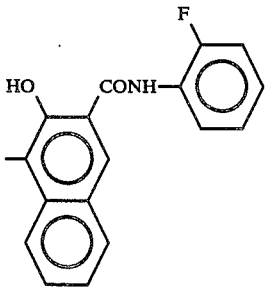 | (31) |
| 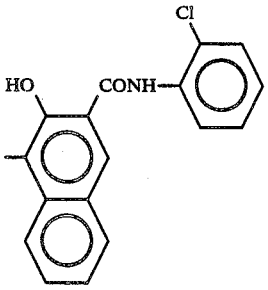 | (32) |
| 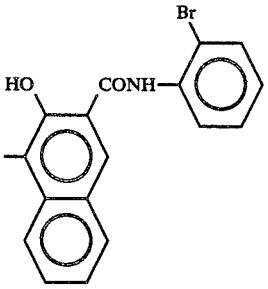 | (33) |
-continued
| | Pigment No. |
|---|---|
| 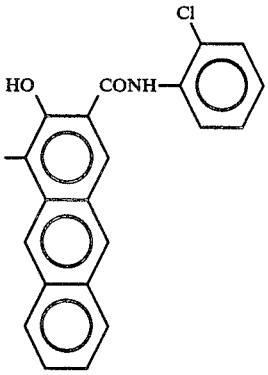 | (34) |
| 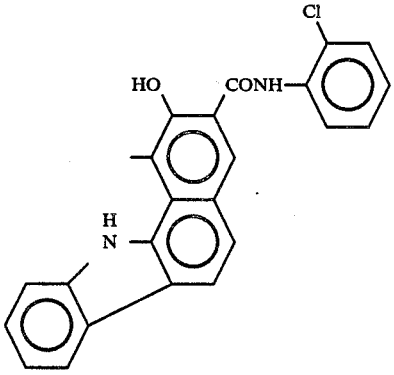 | (35) |
| 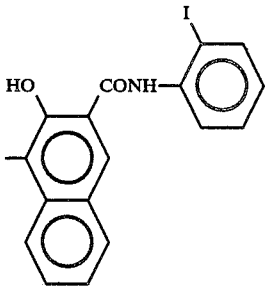 | (36) |
| 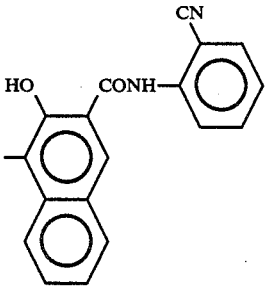 | (37) |
| 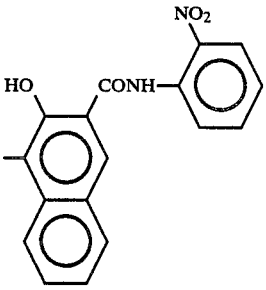 | (38) |

-continued
Pigment No.
(39)
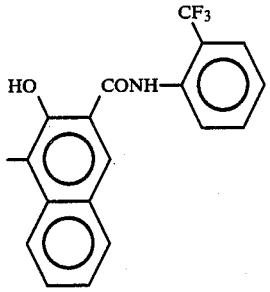
[VII]
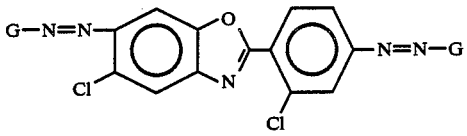
wherein G is:
Pigment No.
(40)
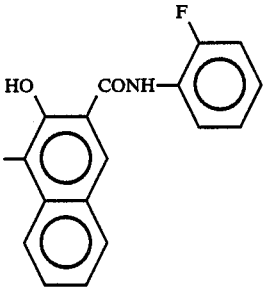
(41)
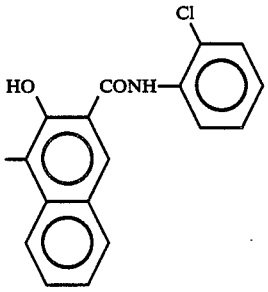
(42)
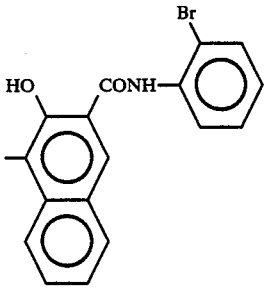
-continued
Pigment No.
(43)
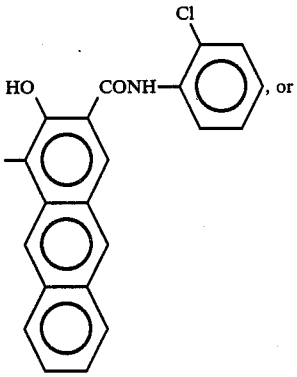
(44)
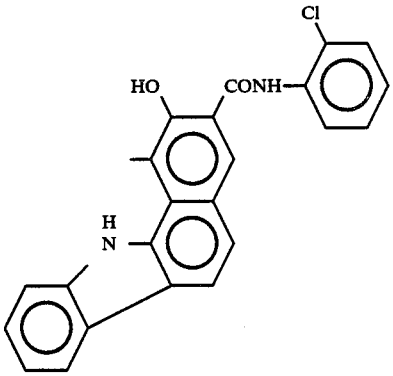
[VIII]
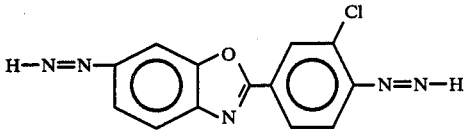
wherein H is:
Pigment No.
(45)
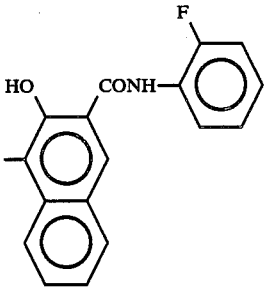
(46)
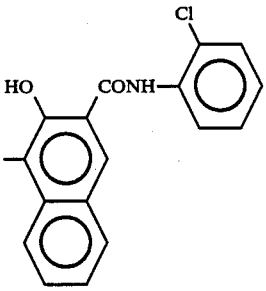

-continued
Pigment No.
(47)
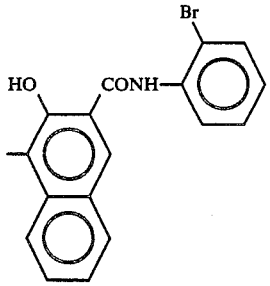
(48)
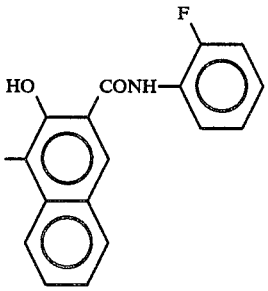
(49)
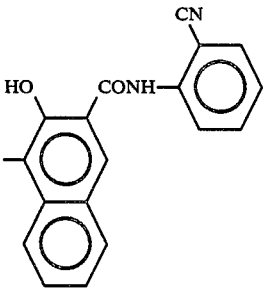
(50)
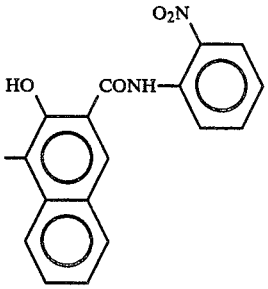
(51)
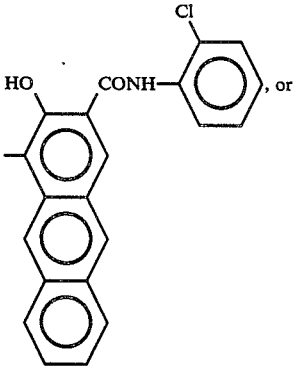
-continued
Pigment No.
(52)
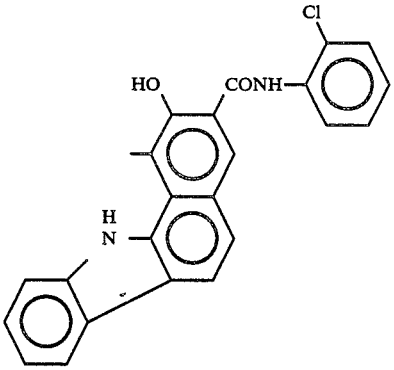
[IX]
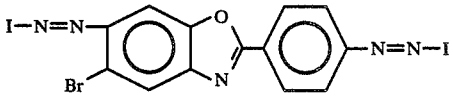
wherein I is:
Pigment No.
(53)
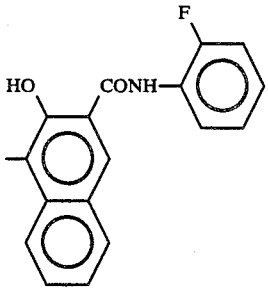
(54)
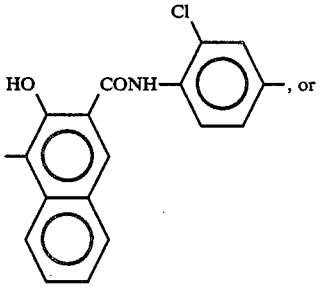
(55)
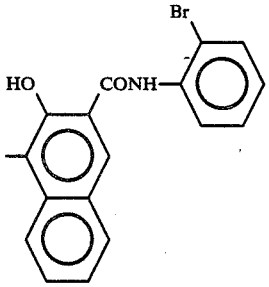

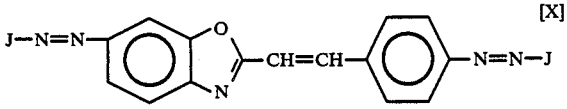
[X]
wherein J is:
| Pigment No. | |
|---|---|
| (56) | 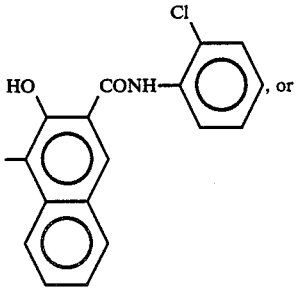 |
| (57) | 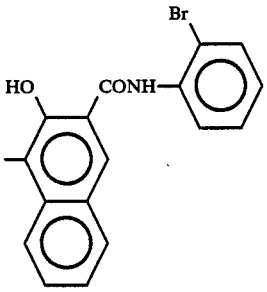 |
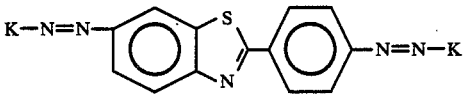
[XI]
wherein K is:
| Pigment No. | |
|---|---|
| (58) | 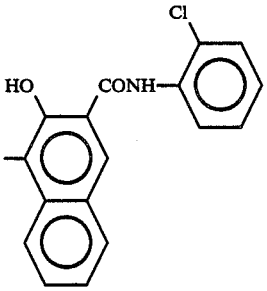 |
| (59) | 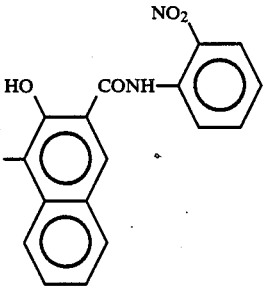 |
-continued
| Pigment No. | |
|---|---|
| (60) | 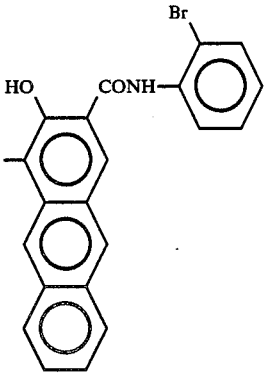 |
| (61) | 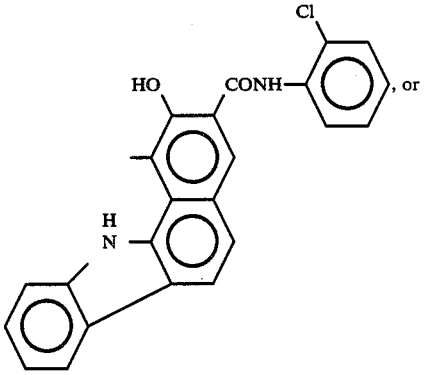 |
| (62) | 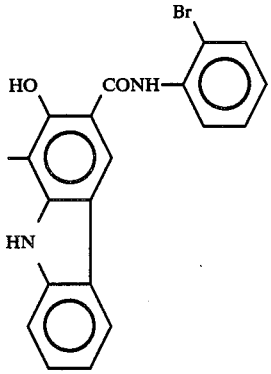 |
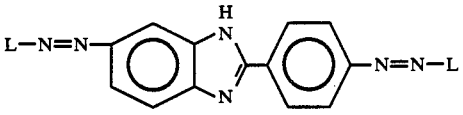
[XII]
wherein L is:

Pigment No.
(63)
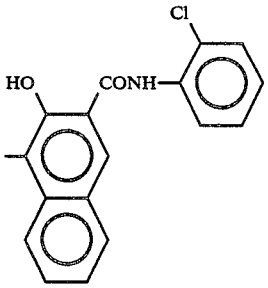
(64)
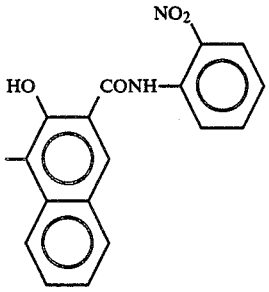
(65)
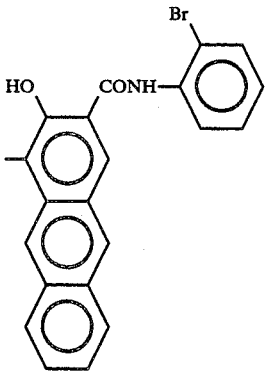
(66)
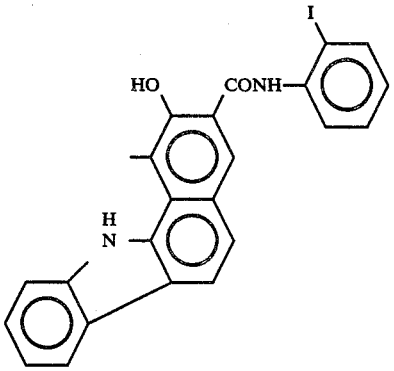
-continued
Pigment No.
(67)
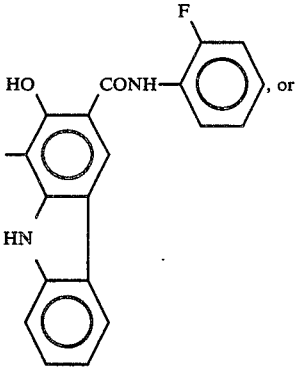
(68)
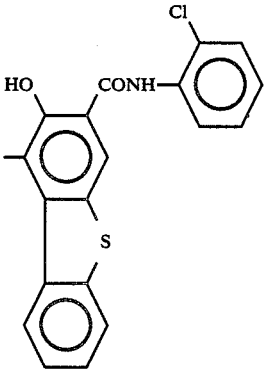
[XIII]
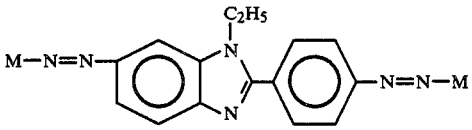
wherein M is:
Pigment No.
(69)
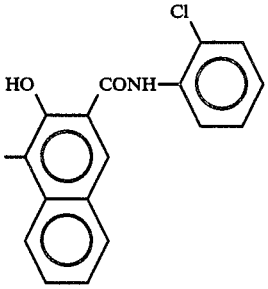
(70)
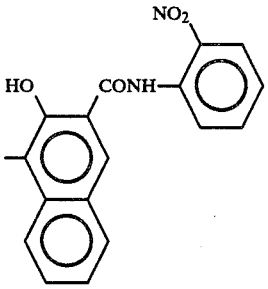

-continued
Pigment No.
(71)
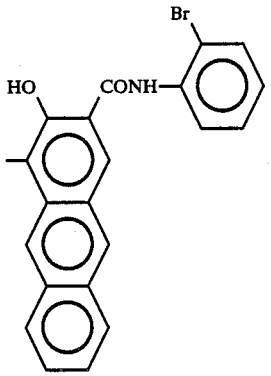
(72)
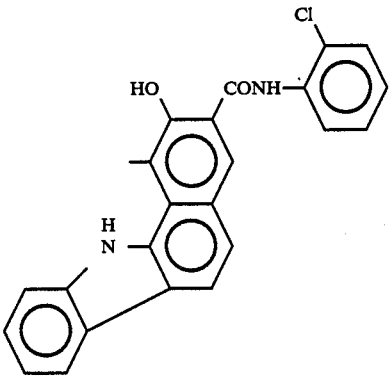
(73)
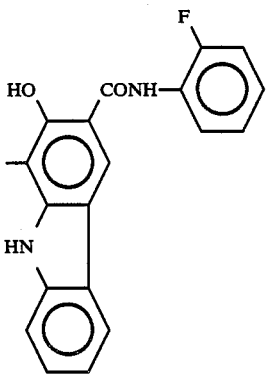
(74)
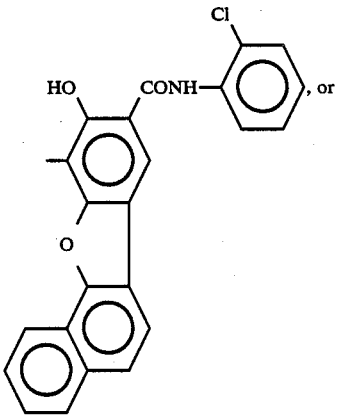
-continued
Pigment No.
(75)
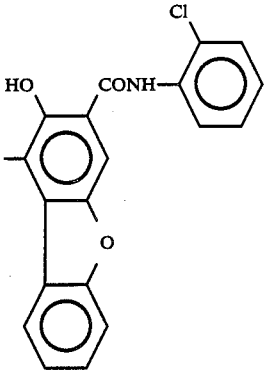
[XVI]
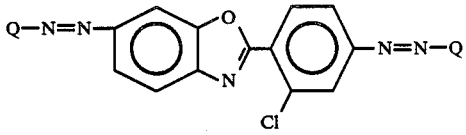
wherein Q is:
Pigment No.
(76)
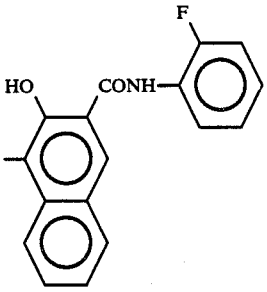
(77)
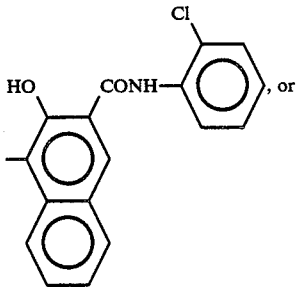
(78)
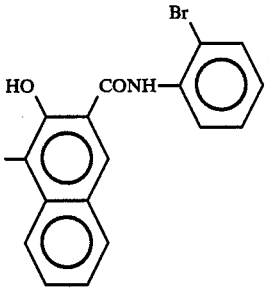

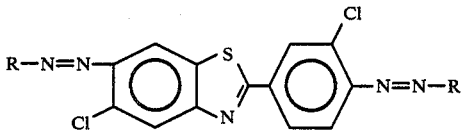

[XV]

wherein R is:

| Pigment No. | |
|---|---|
| 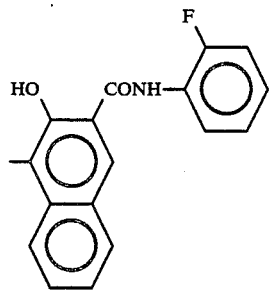 | (79) |
| 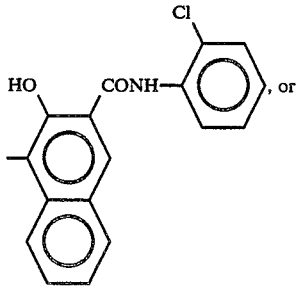 | (80) |
| 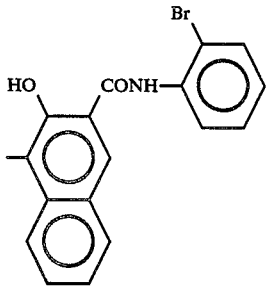 | (81) |

The disazo pigment of general formula [I] for use in the present invention can be readily prepared by diazotizing a diamine represented by the general formula [XVI]

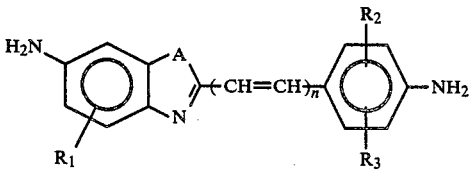

[XVI]

wherein A, $R_1$, $R_2$, $R_3$ and n have the same meanings as defined above, according to the ordinary method, and then subjecting the diazotized diamine to coupling reaction with a coupler represented by the general formula [XVIII] in the presence of an alkali:

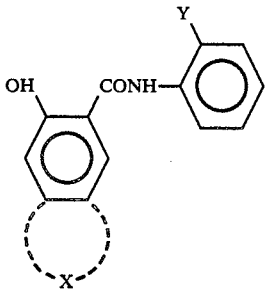

[XVII]

wherein X and Y have the same meanings as defined above, or by once isolating a tetrazonium salt or a hexazonium salt of the diamine of general formula [XVI] in the form of borofluoride salt or zinc chloride salt and then subjecting it to coupling reaction with the coupler of general formula [XVII] in the presence of an alkali in an appropriate solvent such as N,N-dimethylformamide, dimethylsulfoxide, etc.

The present electrophotographic photosensitive member is characterized by a photosensitive layer containing a disazo pigment represented by the general formula [I], and are applicable to any of the followig electrophotographic photosensitive members (1'), to (5'), but in order to enhance the transport efficiency of charge carriers generated by light absorption of the disazo pigment represented by the general formula [I], it is desirable to use the present photosensitive member as the following photosensitive members of types (2'), (3') and (4').

(1') the one provided with a layer of a pigment as dispersed in an insulating binder on an electroconductive layer, as disclosed in Japanese Patent Publication No. 1667/1977 with the title "Electrophotographic plate";

(2') the one provided with a pigment as dispersed in a charge transport material or a charge transport medium comprising the charge transport material and an insulating binder (which may be a charge transport material by itself) on an electroconductive layer, as disclosed in Japanese Patent Application Laid-open No. 30328/1972 with the title "Electrophotographic plate" and Japanese Patent Application Laid-open No. 18545/1972 with the title "Electrophotographic process";

(3') the one comprising an electroconductive layer, a charge generation layer containing an organic pigment and a charge transport layer, as disclosed in Japanese Patent Application Laid-open No. 105537/1974 with the title "Electrophotographic plate";

(4') the one having a charge transfer complex containing an organic pigment, as disclosed in Japanese Patent Application Laid-open No. 91648/1974 with the title "Photoconductive member"; and (5') others.

The photosensitive member of type (3') in which the function to generate charge carriers is separated from the function to transport the charge carriers is desirable for maximizing the characteristics of the pigment. In any of the photosensitive members, amorphous or crystalline pigments can be used.

The electrophotographic photosensitive member of type (3') will be described in detail below:

An electroconductive layer, a charge generation layer and a charge transport layer are essential for the layer structure. The charge generation layer may be on the upper side or lower side of the charge transport layer. A bonding layer may be provided, if necessary, to increase the adhesion between the elctroconductive layer and the charge generation layer or the charge transport layer.

An electrophotographic photosensitive layer comprising an electroconductive layer, a bonding layer, a charge generation layer and a charge transport layer, provided in this order, will be described below:

The electroconductive layer for use in the present electrophotographic photosensitive member includes supports having an electroconductivity by itself, such as metal plates, metal foils or metal cylinder of, for example, aluminum, aluminum alloy, copper, zinc, stainless steel, vanadium, molybdenum, chromium, titanium, nickel, indium, gold, platinum, etc., and plastic plates, films or cylinders of, for example, polyethylene, polypropylene, polyvinyl chloride, polyethylene terephthalate, acrylic resin, phenol resin, polyfluoroethylene, etc. having a film layer formed from aluminum, aluminum alloy, indium oxide, tin oxide, indium oxide-tin oxide alloy, etc. by a vacuum vapor deposition method. Plastic plates, films or cylinder pasted with the metal foil can be also used.

Substrates prepared by coating a plastic or said electroconductive support with electroconductive particles such as a metal oxide, for example, tin oxide, zinc oxide, titanium oxide, etc.; metal particles of, for example, aluminum, copper, zinc, silver, etc.; and carbon black, etc. together with an appropriate binder, substrates prepared by impregnating a plastic or paper with electroconductive particles, or plastics, etc. containing an electroconductive polymer can be used.

Effective materials for the bonding layer include, for example, resins such as casein, polyvinyl alcohol, water-soluble polyethylene, nitrocellulose, etc. The appropriate thickness of the bonding layer is 0.1 to 5 μm, preferably 0.5 to 3 μm.

The charge generation layer can be provided on the electroconductive layer or the bonding layer provided on the electroconductive layer by pulverizing the disazo pigment represented by the general formula [I] into fine particles, dispersing the fine particles in a solution without a binder or if necessary with an appropriate binder, applying the dispersion to the layer, and then drying the applied dispersion.

For the dispersion of disazo pigment, a known procedure using a ball mill, an attriter, a sand mill, etc. can be employed, and it is desirable that the pigment particles have particle sizes of 5 μm or less, preferably 2 μm or less, most preferably 0.5 μm or less.

The disazo pigment can be applied in solution in an amine-based solvent such as ethylenediamine, etc. according to the ordinary method with a blade, a Meyer bar or by spraying or dipping.

It is desirable that the charge generation layer has a thickness of 5 μm or less, preferably 0.01 to 1 μm. When a binder is used in the charge generation layer, a larger amount of the binder gives an adverse effect on the sensitivity, and thus the amount of the binder in the charge generation layer is 80% or less, preferably 40% or less.

The binder for use in the present invention includes various resins such as polyvinylbutyral, polyvinyl acetate, polyester, polycarbonate, phenoxy resin, acrylic resin, polyacrylamide, polyamide, polyvinylpyridine resin, cellulose-based resin, urethane resin, epoxy resin, casein, polyvinyl alcohol, etc.

A charge transport layer is provided on the thus formed charge generation layer. When a charge transport material has no ability to form a film, a charge transport layer is formed with a solution of a binder in an appropriate organic solvent, followed by coating and drying according to the ordinary procedure.

The charge transport material includes an electron-transporting material and a hole-transporting material.

The electron-transporting material includes electron attractive materials such as chloranil, bromanil, tetracyanoethylene, tetracyanoquinodimethane, 2,4,7-trinitro-9-fluorenone, 2,4,5,7-tetranitrofluorenone, 2,4,7-trinitro-9-dicyanomethylenefluorenone, 2,4,5,7-tetranitroxanthone, 2,4,8-trinitrothioxanthone, etc., or polymers of these electron attractive materials.

Appropriate hole-transporting material includes, for example,

Hydrazones:

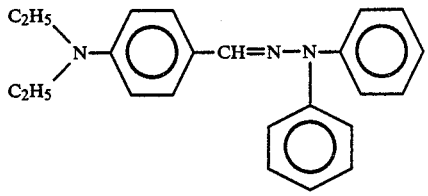

(1)

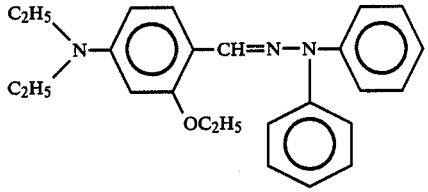

(2)

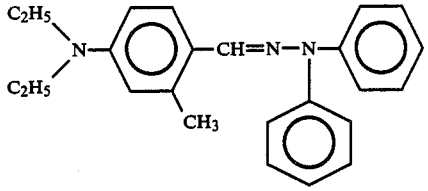

(3)

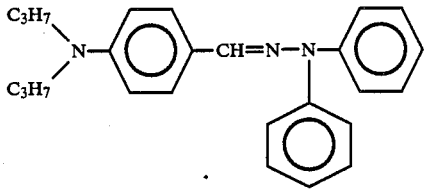

(4)

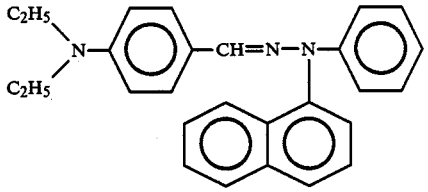

(5)

-continued (6)

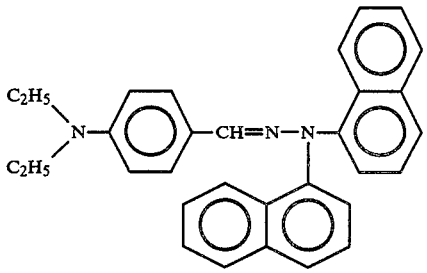

(7)

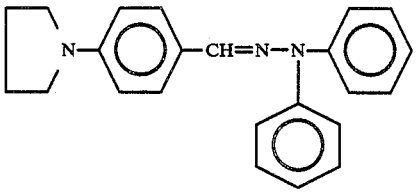

(8)

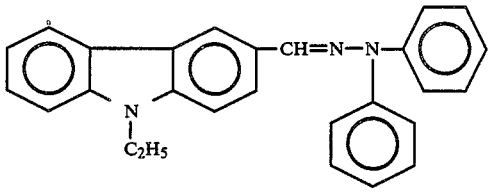

(9)

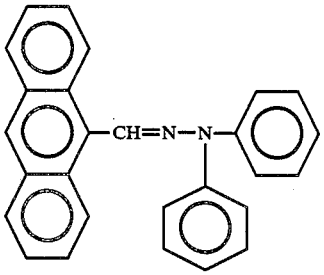

(10)

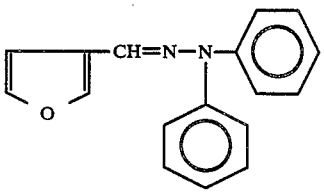

(11)

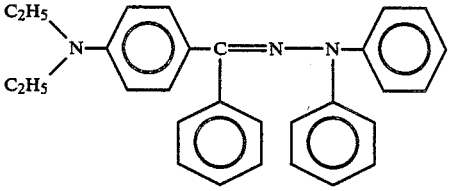

-continued (12)

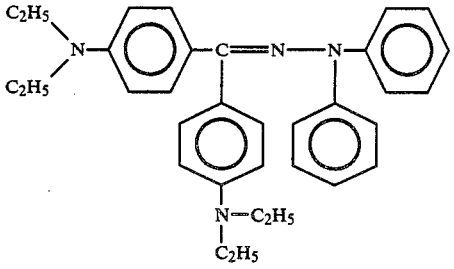

Pyrazolines:

(1) 1-phenyl-3-(4-N,N-diethylaminostyryl)-5-(4,N,N-diethylaminophenyl)pyrazolene (2) 1-phenyl-3-(4-N,N-dipropylstyryl)-5-(4-N,N-diethylaminophenyl)pyrazoline (3) 1-phenyl-3-(4-N,N-dibenzylstyryl)-5-(4-N,N-dibenzylaminophenyl)pyrazoline (4) 1-[pyridyl-(2)]-3-(4-N,N-diethylaminostyryl)-5-(4-N,N-diethylaminophenyl)pyrazoline (5) 1-[quinolyl-(2)]-3-(4-N,N-diethylaminostyryl)-5-(4-N,N-diethylaminophenyl)pyrazoline (6) 1-[quinolyl-4]-3-(4-N,N-diethylaminostyryl)-5-(4-N,N-diethylaminophenyl)pyrazoline (7) 1-[3-methoxy-pyridyl-(2)]-3-(4-N,N-diethylaminostyryl)-5-(4-N,N-diethylaminophenyl)pyrazoline (8) 1-[lepidyl-(2)]-3-(4-N,N-diethylaminostyryl)-5-(4,N,N-diethylaminophenyl)pyrazoline (9) 1-phenyl-3-(4-N,N-diethylaminostyryl)-4-methyl-5-(4-N,N-diethylaminophenyl)pyrazoline

(10) 1-phenyl-3-(α-methyl-4-N,N-diethylaminostyryl)-5-(4-N,N-diethylaminophenyl)pyrazoline

(11) 1-[pyridyl-(3)]-3-(4,N,N-diethylaminostyryl)-5-(4-N,N-diethylaminophenyl)pyrazoline

(12) 1-phenyl-3-(α-benzyl-4-N,N-diethylaminostyryl)-5-(4-N,N-diethylaminophenyl)pyrazoline Diarylalkanes:

(1) 1,1-bis(4-N,N-dimethylaminophenyl)propane (2) 1,1-bis(4-N,N-diethylaminophenyl)propane (3) 1,1-bis(4-N,N-diethylamino-2-methylphenyl)propane (4) 1,1-bis(4-N,N-diethylamino-2-methoxyphenyl)propane (5) 1,1-bis(4-N,N-dibenzylamino-2-methoxyphenyl)-2-methylpropane (6) 1,1-bis(4-N,N-diethylamino-2-methylphenyl)-2-phenylpropane (7) 1,1-bis(4-N,N-diethylamino-2-methylphenyl)heptane (8) 1,1-bis(4-N,N-dibenzylamino-2-methylphenyl)-1-cyclohexylmethane (9) 1,1-bis(4-N,N-dimethylaminophenyl)pentane

(10) 1,1-bis(4-N,N-dibenzylaminophenyl)-n-butane

Triarylalkanes:

(1) 1,1-bis(4-N,N-dimethylaminophenyl)-1-phenylmethane (2) 1,1-bis(4-N,N-diethylaminophenyl)-1-phenylmethane (3) 1,1-bis(4-N,N-diethylamino-2-methylphenyl)-1-phenylmethane (4) 1,1-bis(4-N,N-diethylamino-2-ethylphenyl)-2-phenylethane (5) 1,1-bis(4-N,N-diethylamino-2-methylphenyl)-3-phenylpropane (6) 1,1-bis(4-N,N-diethylamino-2,5-dimethoxyphenyl)-3-phenylpropane Oxadiazoles:
(1) 2,5-bis(4-N,N-dimethylaminophenyl)-1,3,4-oxadiazole
(2) 2,5-bis(4-N,N-diethylaminophenyl)-1,3,4-oxadiazole
(3) 2,5-bis(4-N,N-dipropylaminophenyl)-1,3,4-oxadiazole
(4) 2,5-bis(4-N,N-dibenzylaminophenyl)-1,3,4-oxadiazole
(5) 2-methyl-5-(3-carbazolyl)-1,3,4-oxiadiazole
(6) 2-ethyl-5-(3-carbazolyl)-1,3,4-oxadiazole
(7) 2-ethyl-5-(9-ethyl-3-carbazolyl)-1,3,4-oxadiazole
(8) 2-N,N-diethylamino-5-(9-ethyl-3-carbazolyl)-1,3,4-oxadiazole
(9) 2-styryl-5-(3-carbazolyl)-1,3,4-oxadiazole Anthracenes:
(1) 9-styrylanthracene
(2) 9-(4-N,N-dimethylaminostyryl)anthracene
(3) 9-(4-N,N-diethylaminostyryl)anthracene
(4) 9-(4-N,N-dibenzylaminostyryl)anthracene
(5) 4-bromo-9-(4-N,N-diethylaminostyryl)anthracene
(6) α-(9-anthryl)-β-(3-carbazolyl)ethylene
(7) α-(9-anthryl)-α-(9-ethyl-3-carbazolyl)ethylene Oxazoles:
(1) 2-(4-N,N-diethylaminophenyl)-4-(4-N,N-dimethylaminophenyl)-5-(2-chlorophenyl)oxazole
(2) 2-(4-N,N-diethylaminophenyl)-5-phenyloxazole
(3) 4-(4-N,N-dimethylaminophenyl)-5-(2-chlorophenyl-)oxazole
(4) 2-(4-N,N-dimethylaminophenyl)-4,5-diphenyloxazole
(5) 2-(4-N,N-dimethylaminophenyl)-4-(4-N,N:diethylaminophenyl)-5-(2-chlorophenyl)oxazole
(6) 2,5-di-(2-chlorophenyl)-4-(4-N,N-diethylaminophenyl)oxazole Stilbenes:
(1) 4,4'-bis(diethylamino)stilbene
(2) 4-diphenylamino-4'-methoxystilbene
(3) 4-diethylamino-α-(p-diethylaminophenyl)stilbene
(4) 3-(p-methoxystyryl)-9-p-methoxyphenylcarbazole; etc.

In addition, pyrene, N-ethylcarbazole, triphenylamine, poly-N-vinylcarbazole, halogenated poly-N-vinylcarbazole, polyvinylpyrene, polyvinylanthracene, polyvinylacridine, poly-9-vinylphenylanthracene, pyreneformaldehyde resin, ethylcarbazole formaldehyde resin, etc. can be also used.

The charge transporting material is not limited to those described above, and can be used alone or in a mixture of at least two thereof. The charge transport layer has a thickness of 5 to 30 μm, preferably 8 to 20 μm.

The binder for use in the present invention includes acrylic resin, polystyrene, polyester, polycarbonate, etc. As the binder of the low molecular weight, hole transporting material, the aforementioned hole-transporting polymers such as poly-N-vinylcarbazole, etc. can be used, whereas as the low molecular weight, electron-transporting material, polymers of electron transporting monomers as disclosed in U.S. Pat. No. 4,122,113 can be used.

When the charge transporting material is composed of an electron-transporting material in a photosensitive member comprising an electroconductive layer, if necessary, a bonding layer, a charge generation layer, and the charge transport layer, provided in this order, it is necessary to positively charge the surface of the charge transport layer. When the photosensitive member is exposed to light after the charging, the electrons generated in the charge generation layer at the light-exposed parts are injected into the charge transport layer, and then reach the surface to neutralize the positive charges to attenuate the surface potential and form an electrostatic contrast between the light-exposed parts and the unexposed parts. When the thus formed electrostatic latent image is developed with negatively chargeable toners, a visible image can be obtained. The toner image can be either directly fixed, or transferred onto paper or a plastic film, then developed and fixed. Or, the electrostatic latent image on the photosensitive member can be transferred onto the insulating layer of transfer paper, then developed and fixed. Any kind of known developing agents and any of known developing and fixing methods can be used without any limitation to specific ones.

When the charge transporting material is composed of a hole-transporting material on the other hand, it is necessary to negatively charge the surface of the charge transport layer. When the photosensitive member is exposed to light after the charging, the holes generated in the charge generation layer at the light exposed parts are injected into the charge transport layer and then reach the surface to neutralize the negative charges, attenuate the surface potential and form an electrostatic contrast between the light-exposed parts and the unexposed parts. At the development it is necessary to use positively chargeable toners contrary to the case of using the electron-transporting material.

The photosensitive member of type (1') can be obtained by dispersing a disazo pigment represented by the general formula [I] in a solution of an insulating binder as used in the charge transport layer of the photosensitive member of type (3'), applying the dispersion to an electroconductive support, and drying the applied dispersion.

The photosensitive member of type (2') can be obtained by dissolving the charge transporting material or the charge transporting material and the insulating binder as used in the charge transport layer of the photosensitive member of type (3') in an appropriate solvent, dispersing a disazo pigment represented by the general formula [I] therein, applying the dispersion to an electroconductive support, and drying the applied dispersion.

The photosensitive member of type (4') can be obtained by dispersing a disazo pigment represented by the general formula [I] in a solution of a charge transfer complex formed from a combination of the electron-transporting material and the hole-transporting material as mentioned with regard to the photosensitive member of type (3'), applying the dispersion to an electroconductive support, and drying the applied dispersion.

The disazo pigment for use in any of the foregoing photosensitive members contains at least one pigment selected from the disazo pigments represented by the general formula (I), and can be used together with a pigment having a different light absorption, if necessary, to enhance the sensitivity of the photosensitive member, or can be used in a mixture of at least two of the disazo pigments represented by the general formula (I) or in a combination with a charge-generating material selected from known dyes and pigments to obtain a panchromatic photosensitive member.

The present electrophotographic photosensitive member can be utilized not only in electrophotographic copying machines, but also widely in electrophotographic applications including a laser printer, a CRT printer, etc.

A synthesis example of a disazo pigment for use in the present invention will be described in detail below:

Synthesis Example

Synthesis of a pigment having the following formula:

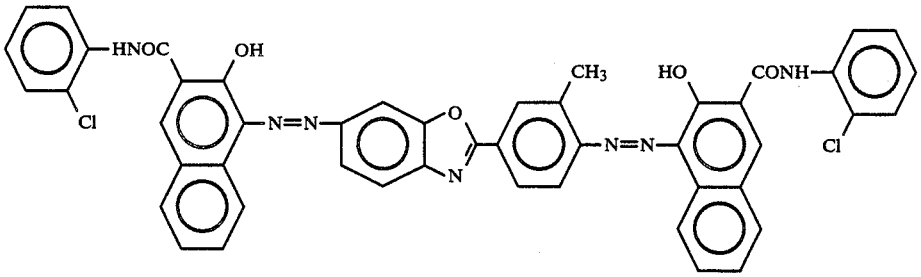

A solution composed of 6.22 g (0.026 moles) of 2-(4-amino-3-methylphenyl)-6-aminobenzoxazole, 50 ml of water and 32 ml of concentrated hydrochloric acid was cooled to 4° C., and a solution containing 3.77 g (0.0546 moles) of sodium sulfite in 13 ml of water was dropwise added thereto over 15 minutes. Then, the mixture was stirred for 30 minutes, while keeping the liquid temperature at 3° to 5° C., and activated carbon was added thereto. Then, the mixture was filtered to obtain an aqueous tetrazonium salt solution.

Separately, 19.9 g (0.057 moles) of 3-hydroxy-2-naphtoic acid-0-chloranilide and 47.5 g of pyridine were dissolved in 1,200 ml of DMF, and the said tetrazonium salt soluton was dropwise added to the solution over 30 minutes while keeping the liquid temperature at 5° to 10° C. Then, the mixture was stirred for 2 hours. Then, the reaction mixture was filtered, and the thus obtained pigment was washed with water, and dispersed and washed in 800 ml of acetone, and then dried, whereby 20.0 g crude pigment was obtained. Then, the crude pigment was washed twice each with 800 ml of DMF and dispersed and washed twice each in 800 ml of THF, and recovered by filtration, and dried in reduced pressure, whereby 18.9 g of purified pigment was obtained.

Yield: 85% (based on the diamine)

Decomposition point: 300° C. or higher

Elemental analysis: Molecular formula: $C_{48}H_{31}Cl_2N_2O_5$

| | Calculated (%) | Found (%) |
|---|---|---|
| C | 67.29 | 67.24 |
| H | 3.65 | 3.61 |
| N | 11.45 | 11.46 |
| Cl | 8.28 | 8.24 |

IR (absorption spectrum): secondary amide: 1670 $cm^{-}$.

In the foregoing, the procedure for synthesizing pigment No. 16 has been described, and other disazo pigments can be synthesized in the same manner as above.

Examples of the present invention will be given below.

Example 1

An aqueous solution of polyvinyl alcohol was applied to an aluminum plate having a thickness of 100 μm and dried, whereby a bonding layer having a coating amount of 0.8 $g/m^2$ was formed.

Then, 5 g of said pigment No. 16 and 10 g of polyester resin (polyester adhesive 49000, made by Dupont, USA, solid content: 20%) were dispersed in 80 ml of tetrahydrofuran, and then the dispersion was applied to the bonding layer at a coating amount of 0.3 $g/m^2$ after drying.

Then, 5 g of 4-N,N-diethylaminobenzaldehyde-N,N-diphenylhydrazone and 5 g of bisphenol A-type polycarbonate (number average molecular weight: 26,000) were dissolved in 70 ml of tetrahydrofuran, and then the solution was applied to the charge generation layer to make a film having a thickness of 16μ after drying.

The thus prepared electrophotographic photosensitive member was subjected to corona charging at ⊖ SkV according to a static method using an electrostatic copying machine Model SP-428, made by Kawaguchi Denki K.K., Japan, retained in a dark place for one second and then exposed to light to investigate charging characteristics.

The charging characteristics of the present photosensitive member are given below, where $V_0$ designates an initial potential (V), Vk designates a percent potential retention (%) in the dark place for one second, and $E_{\frac{1}{2}}$ designates a half-decayed light exposure (lux·sec).

$V_0$: ⊖620 (V), Vk: 97%, $E_{\frac{1}{2}}$: 1.8 lux·sec

Comparative Examples 1 to 7

For comparison with Example 1, disazo pigments having the following formulae were evaluated in the same manner as in Example 1 and the results are given in Table 1.

Comparative pigment No.
1
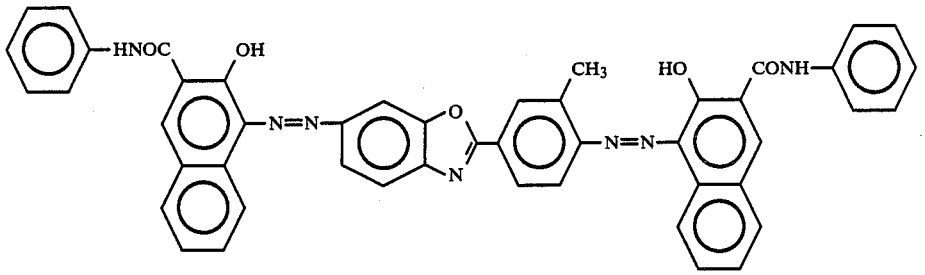
2
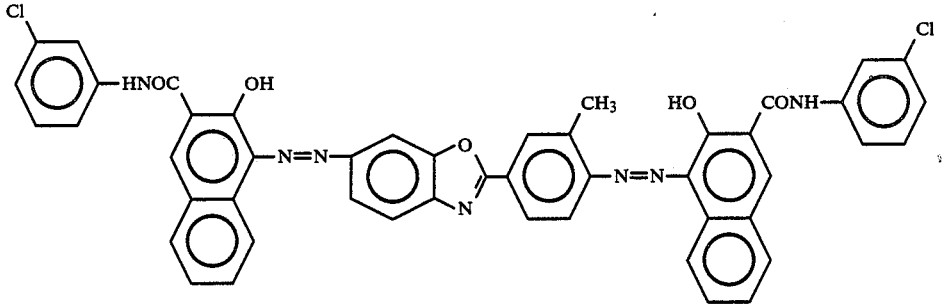
3
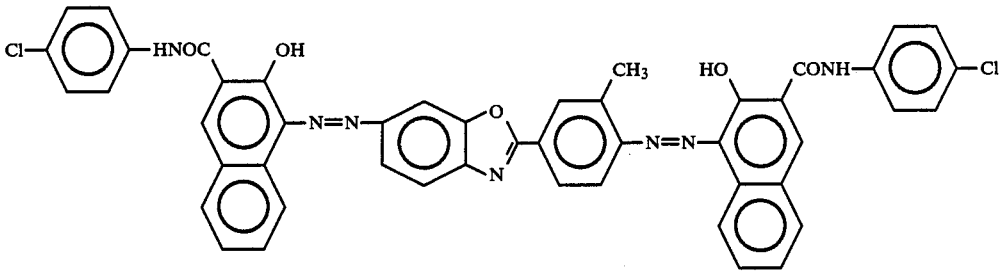
4
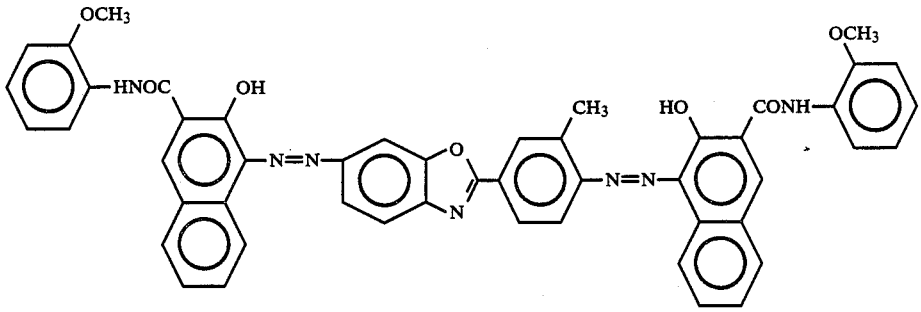
5
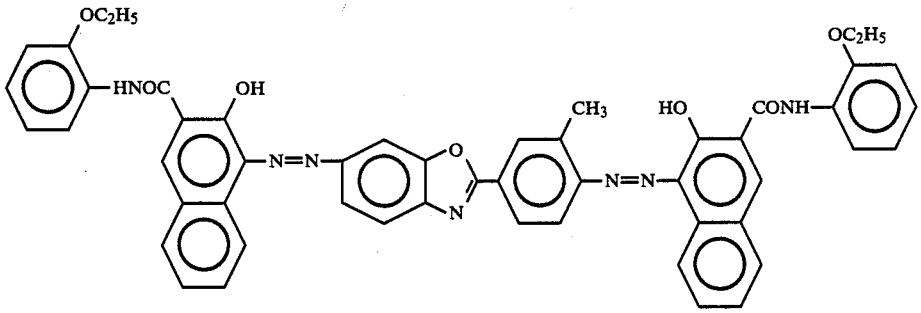

-continued

Comparative pigment No.

6

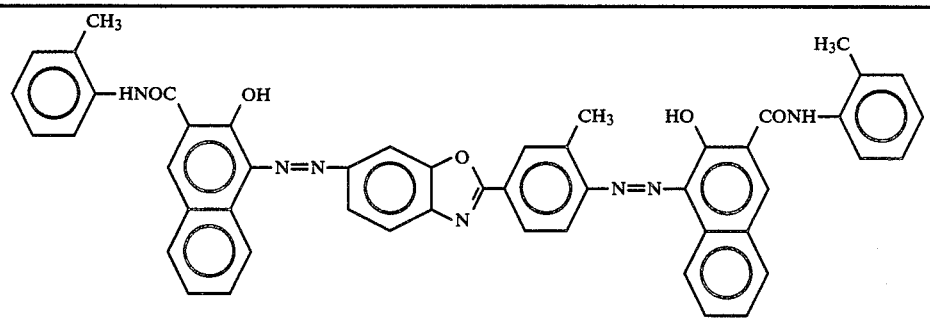

7

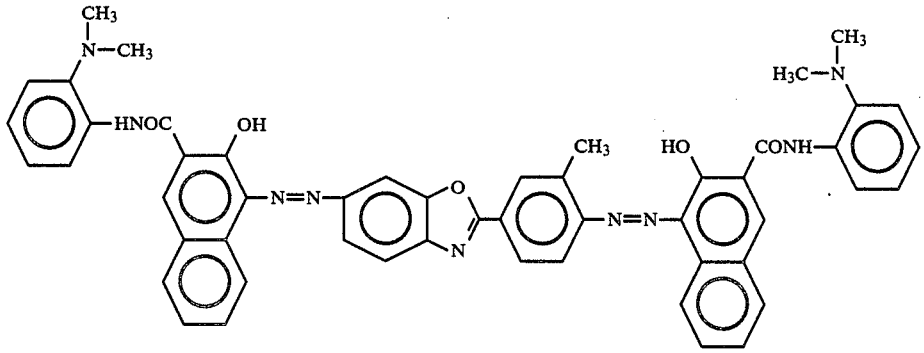

TABLE 1

| Comp. Ex. No. | Comp. pigment No. | $V_0$ (−V) | Vk(%) | $E_{\frac{1}{2}}$ (lux · sec) |
|---|---|---|---|---|
| 1 | 1 | 610 | 97 | 6.3 |
| 2 | 2 | 630 | 98 | 5.7 |
| 3 | 3 | 620 | 98 | 5.8 |
| 4 | 4 | 620 | 97 | 7.3 |
| 5 | 5 | 600 | 96 | 7.8 |
| 6 | 6 | 600 | 97 | 7.9 |
| 7 | 7 | 610 | 97 | 10.0 |

It is obvious from comparison of Example 1 with Comparative Examples 1 and 4 to 7 as regards the characteristics that, when Y of the coupler

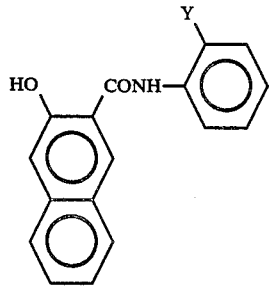

is an electron-attractive Cl, the sensitivity can be peculiarly improved, and it is also obvious from comparison of Example 1 with Comparative Examples 2 and 3 as regards the characteristics that, when the substituent is in an ortho position with respect to CONH—, a peculiarly higher sensitivity can be obtained.

Examples 2 to 9

Photosensitive members were prepared in the same manner as in Example 1, using pigments Nos. 21, 22, 23, 26, 27, 28, 29 and 30 in place of the pigment No. 16 used in Example 1, and their characteristics were examined. The results are shown in Table 2.

TABLE 2

| Example No. | Pigment | $V_0$ (−V) | Vk(%) | $E_{\frac{1}{2}}$ (lux · sec) |
|---|---|---|---|---|
| 2 | Pigment No. (21) | 605 | 98 | 1.4 |
| 3 | Pigment No. (22) | 615 | 97 | 1.5 |
| 4 | Pigment No. (23) | 600 | 96 | 1.7 |
| 5 | Pigment No. (26) | | | |
| 6 | Pigment No. (27) | 610 | 97 | 1.8 |
| 7 | Pigment No. (28) | 600 | 97 | 2.3 |
| 8 | Pigment No. (29) | 590 | 98 | 2.0 |
| 9 | Pigment No. (30) | 610 | 97 | 1.6 |

It is obvious from comparison of Examples 2 to 9 with Comparative Examples 8 to 11 that a peculiarly high sensitivity can be obtained by using electron-attractive substituents as in the present Examples as Y in the general formula [I]. It is also obvious from comparison of Example 2 with Comparative Examples 12 and 13; Example 6 with Comparative Examples 14 and 15; Example 7 with Comparative Examples 16 and 17; and Example 9 with Comparative Examples 18 and 19 as regards the characteristics that a peculiarly high sensitivity can be obtained only when the substituent Y is an O position with respect to —CONH—, even if the substituent is electron-attractive.

Comparative Examples 8 to 19

Photosensitive members were prepared in the same manner as in Example 2, using Comparative pigments 8 to 11, whose Y is electron-donating, in place of the pigments, whose Y is electron-attractive in the general formula [I], as used in Examples 2 to 9, and Comparative pigments 12 to 19 having different positions of substituent Y, which correspond to Examples 2, 6, 7 and 9, respectively, and their characteristics were investigated. The results are shown in Table 3.
| Comparative pigment No. | |
|---|---|
| 8 | 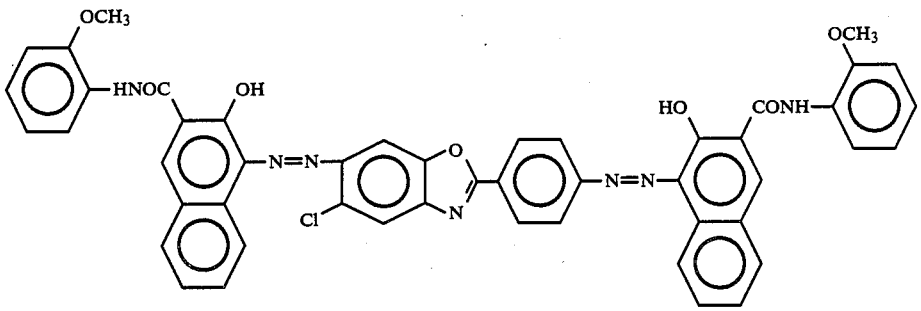 |
| 9 | 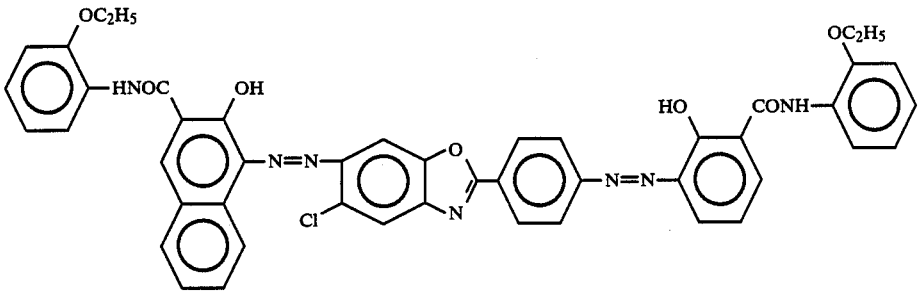 |
| 10 | 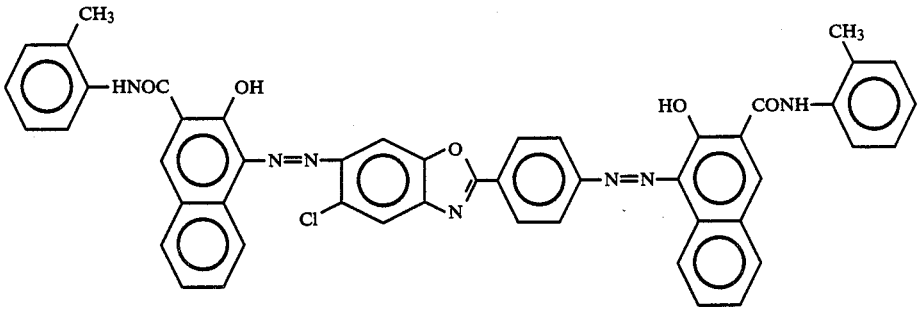 |
| 11 | 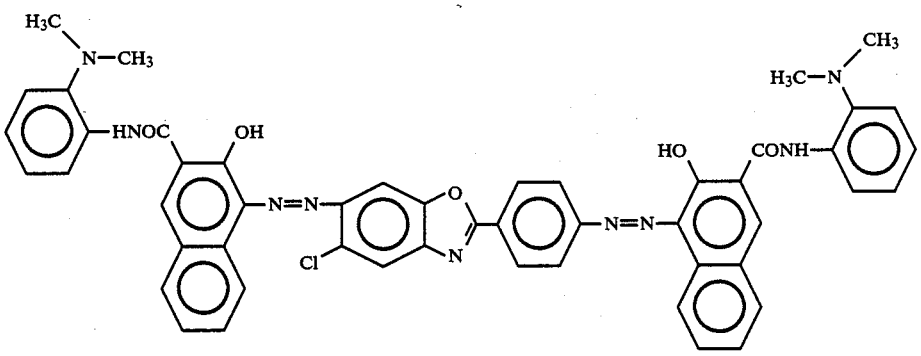 |

-continued
| Comparative pigment No. | |
|---|---|
| 12 | 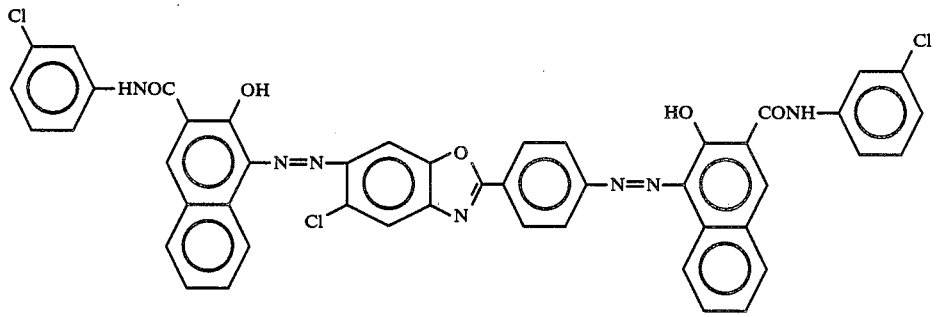 |
| 13 | 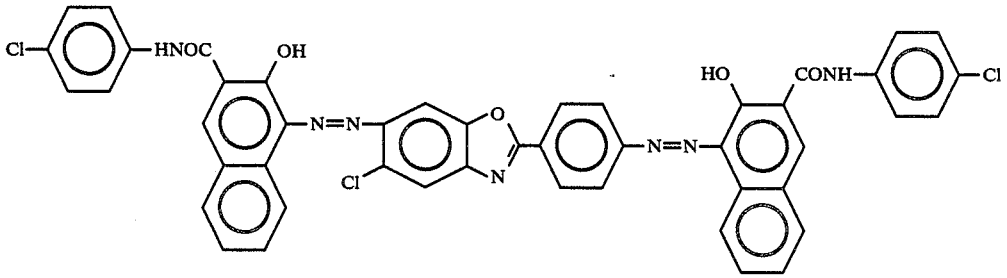 |
| 14 | 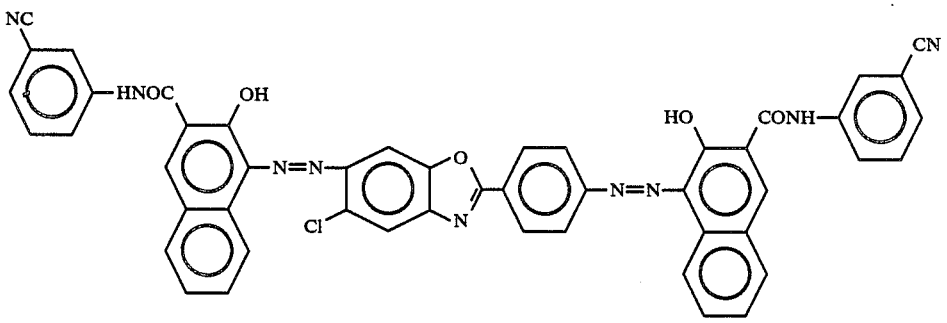 |
| 15 | 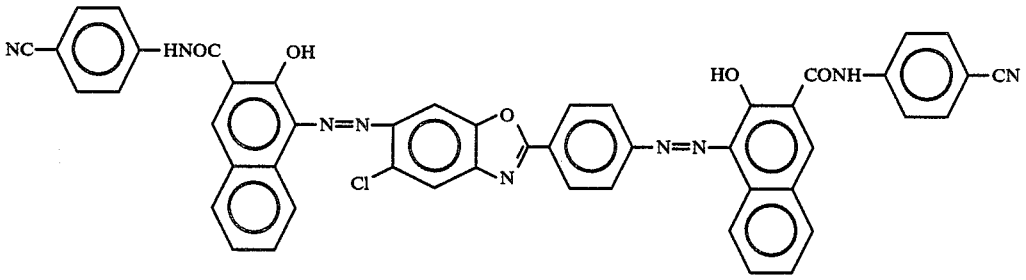 |
| 16 | 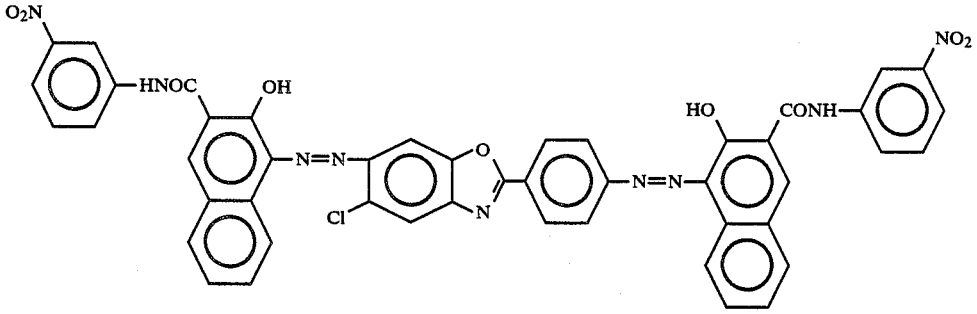 |

-continued

| Comparative pigment No. | |
|---|---|
| 17 | 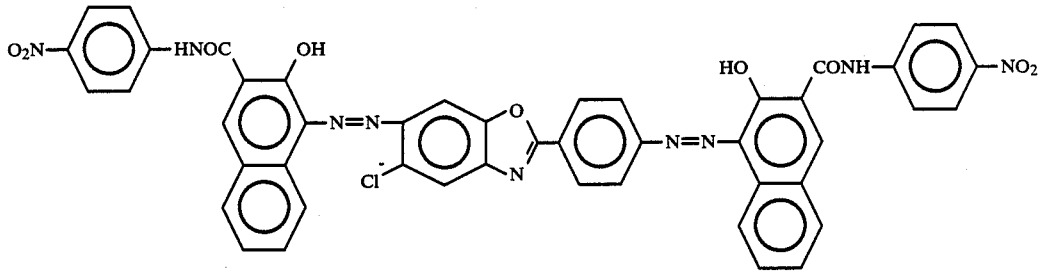 |
| 18 | 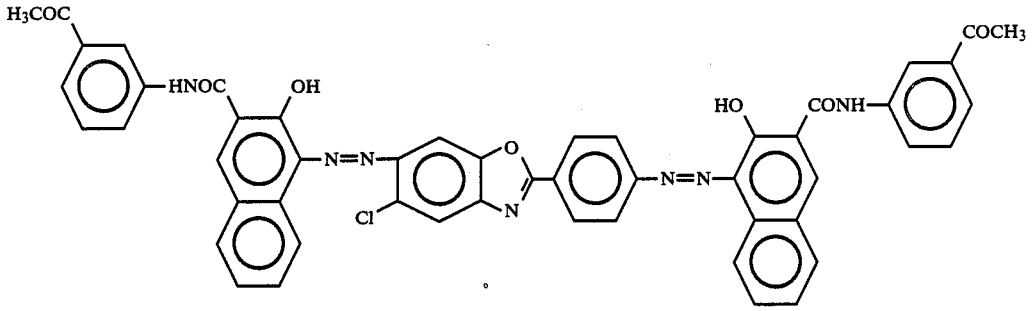 |
| 19 | 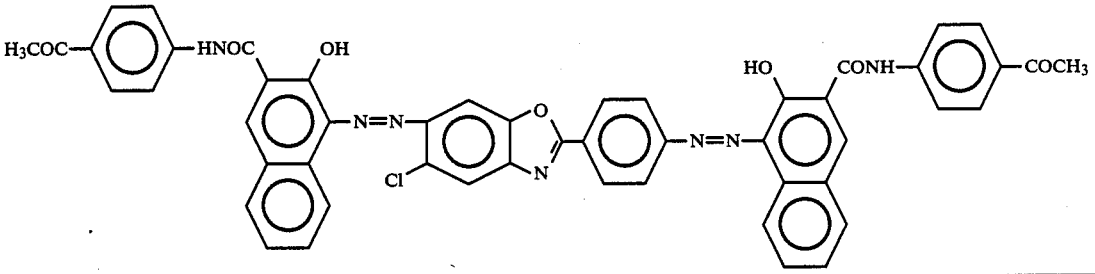 |

TABLE 3

| Comp. Ex. No. | Comp. pigment No. | $V_0$ (−V) | Vk(%) | $E_{\frac{1}{2}}$(lux · sec) |
|---|---|---|---|---|
| 8 | 8 | 580 | 98 | 7.3 |
| 9 | 9 | 580 | 96 | 6.2 |
| 10 | 10 | 610 | 97 | 7.6 |
| 11 | 11 | 600 | 96 | 9.3 |
| 12 | 12 | 580 | 96 | 6.4 |
| 13 | 13 | 590 | 97 | 6.0 |
| 14 | 14 | 600 | 97 | 6.3 |
| 15 | 15 | 610 | 97 | 6.8 |
| 16 | 16 | 620 | 98 | 5.5 |
| 17 | 17 | 610 | 96 | 6.4 |
| 18 | 18 | 590 | 97 | 5.8 |
| 19 | 19 | 600 | 98 | 6.3 |

Example 10

A photosensitive member was prepared in the same manner as in Example 1, using pigment No. 60 in place of the pigment No. 16 used in Example 1, and its characteristics were investigated. The results are shown in Table 4.

TABLE 4

| Example No. | Pigment No. | $V_0$ (−V) | Vk(%) | $E_{\frac{1}{2}}$ (lux · sec) |
|---|---|---|---|---|
| 10 | 60 | 620 | 97 | 2.6 |

Comparative Examples 20 to 24

Photosensitive members were prepared in the same manner as in Example 10, using electron-donating comparative pigments 20 to 22 in place of the pigment whose Y is electron-attractive in the general formula [I], as used in Example 10, and Comparative pigments 23 and 24 having different positions of substituent Y form that of pigment No. 60 as used in Example 10, and their characteristics were investigated. The results are shown in Table 5.

| | Comparative pigment No. |
|---|---|
| 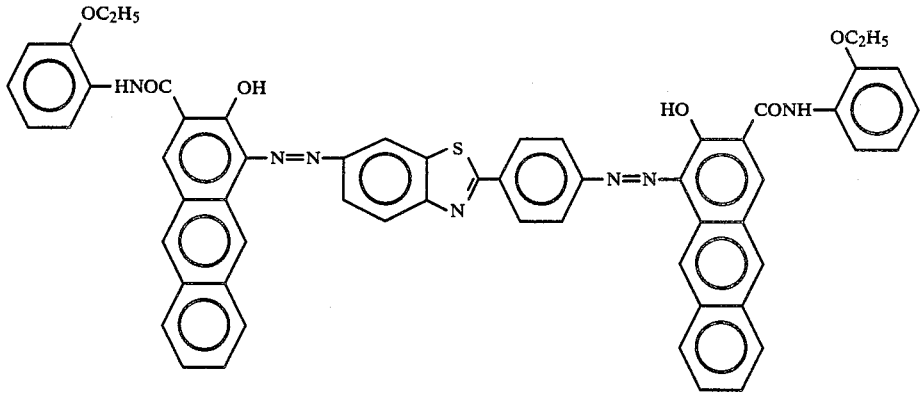 | 20 |
| 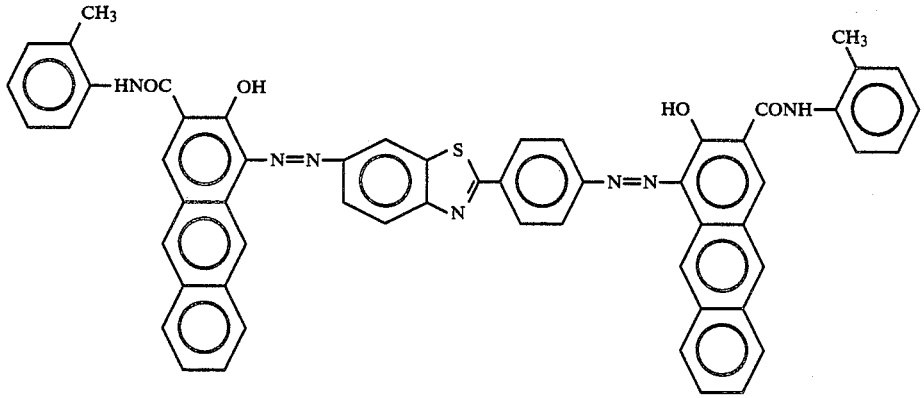 | 21 |
| 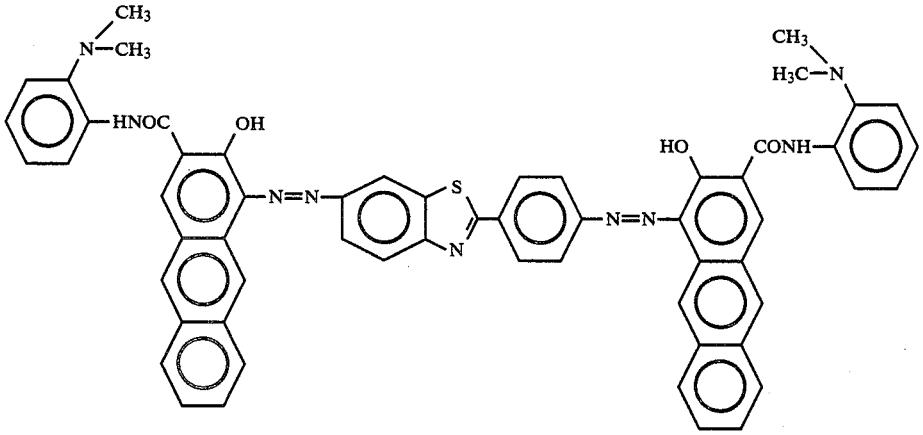 | 22 |
| 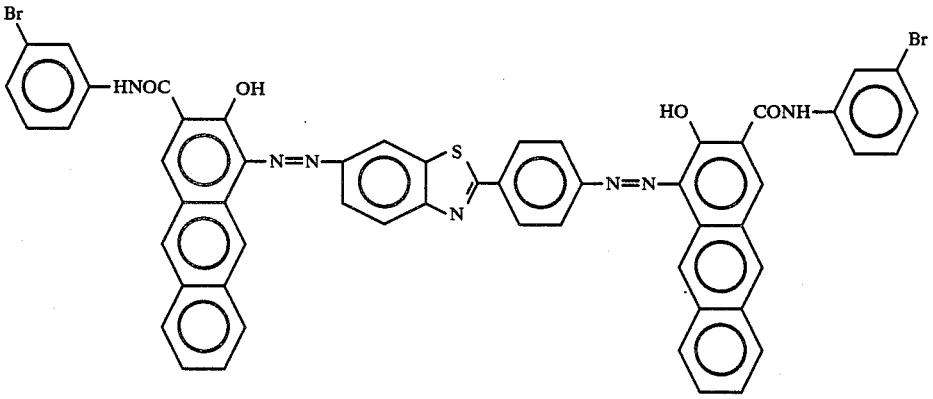 | 23 |

-continued

Comparative pigment No.

24

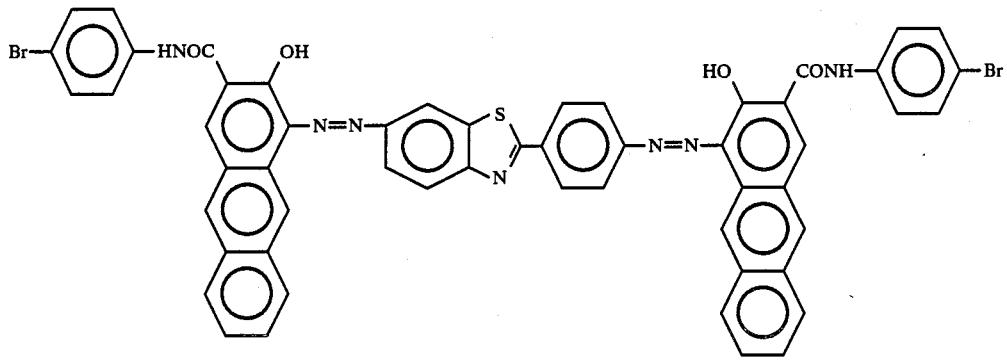

TABLE 5

| Comp. Ex. No. | Com. Pigment No. | $V_0$ (−V) | Vk(%) | $E_{\frac{1}{2}}$(lux · sec) |
|---|---|---|---|---|
| 20 | 20 | 620 | 97 | 6.4 |
| 21 | 21 | 620 | 97 | 6.2 |
| 22 | 22 | 600 | 98 | 8.8 |
| 23 | 23 | 610 | 98 | 5.2 |
| 24 | 24 | 600 | 98 | 5.8 |

It is obvious from the comparison of Example 10 with Comparative Examples 20 to 22 that a peculiarly high sensitivity can be obtained by using an electron-attractive substituent as Y in the general formula [I], as in the present invention. It is also obvious from the comparison of Example 10 with Comparative Examples 23 and 24 that a peculiarly high sensitivity can be attained only when Y is in an ortho position with respect to —CONH—, even if Y is an electron-attractive group.

Example 11

A photosensitive member was prepared in the same manner as in Example 1, using pigment No. 72 in place of the pigment No. 16 used in Example 1, and its characteristics were investigated. The results are shown in Table 6.

TABLE 6

| Example No. | Pigment No. | $V_0$ (−V) | Vk(%) | $E_{\frac{1}{2}}$ (lux · sec) |
|---|---|---|---|---|
| 11 | 72 | 620 | 98 | 2.4 |

Comparative Examples 25 to 29

Photosensitive members were prepared in the same manner as in Example 11, using electron-donating comparative pigments Nos. 25 to 27 in place of the pigment, whose Y is electron-attractive in the general formula [I], as used in Example 11, and comparative pigments Nos. 28 and 29 having different positions of substituent Y from that of pigment No. 72, as used in Example 11, and their characteristics were investigated. The results are shown in Table 7.

Comparative pigment No.

25

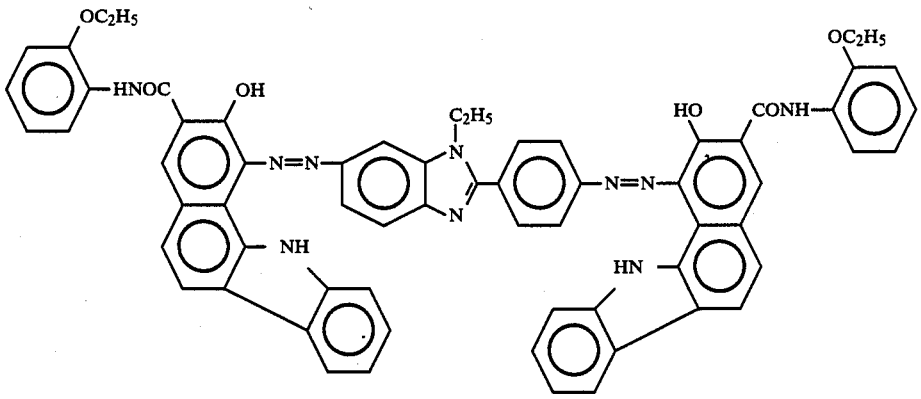

-continued
| | Comparative pigment No. |
|---|---|
| 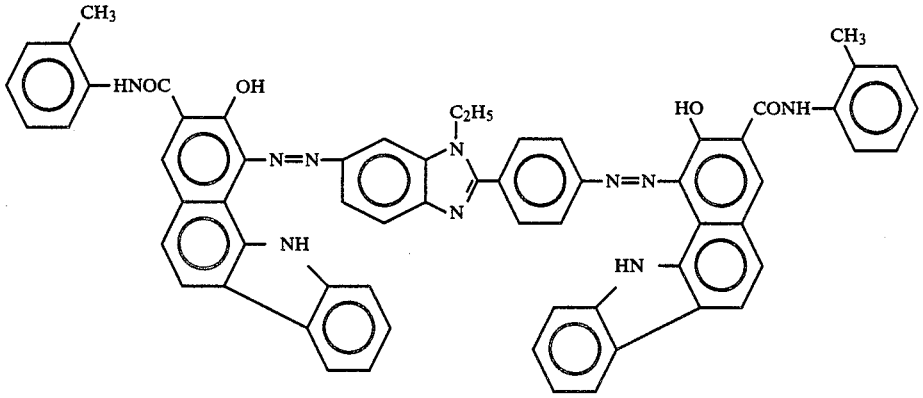 | 26 |
| 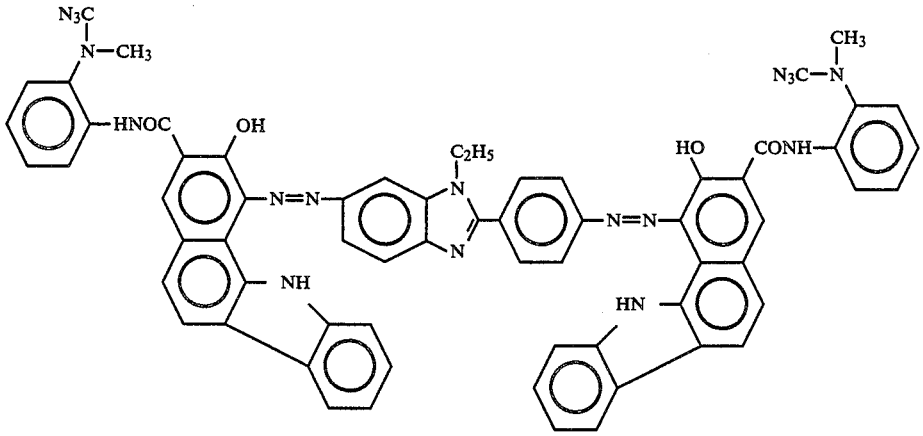 | 27 |
| 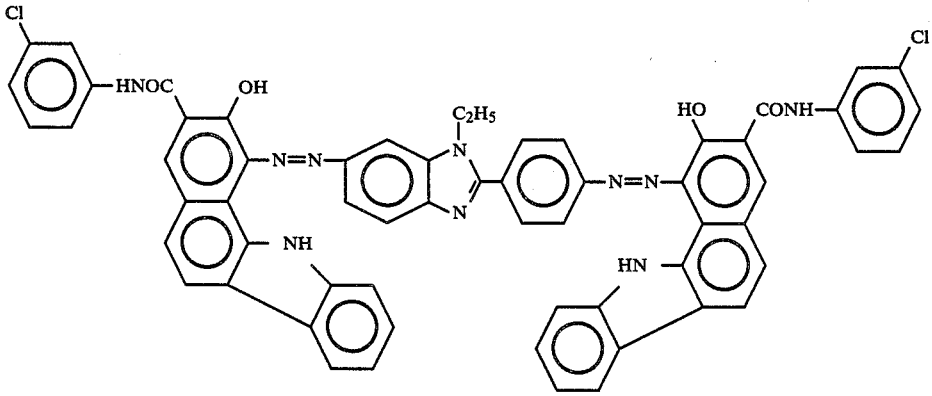 | 28 |

-continued

| | Comparative pigment No. |
|---|---|
| 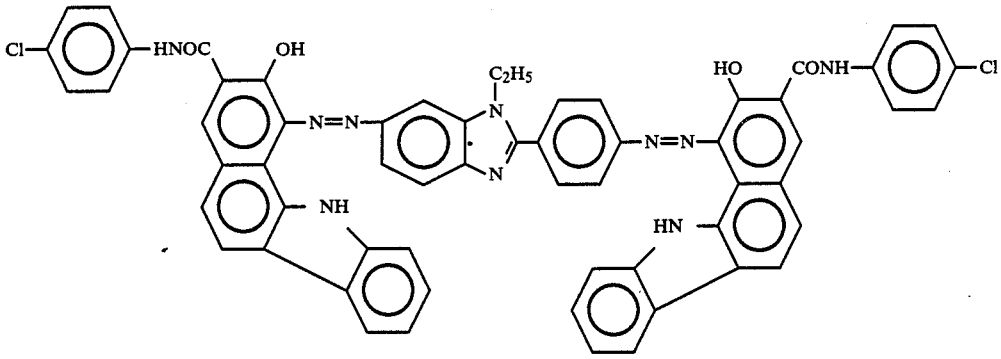 | 29 |

TABLE 7

| Comp. Ex. No. | Comp. pigment No. | $V_0$ (−V) | Vk(%) | $E_{\frac{1}{2}}$(lux · sec) |
|---|---|---|---|---|
| 25 | 25 | 620 | 97 | 7.4 |
| 26 | 26 | 600 | 96 | 5.9 |
| 27 | 27 | 610 | 98 | 9.3 |
| 28 | 28 | 600 | 98 | 6.2 |
| 29 | 29 | 590 | 97 | 6.6 |

It is obvious from the comparison of Example 11 with comparative Examples 25 to 27 that a peculiarly high sensitivity can be obtained by using an electron-attractive substituent as Y in the general formula [I], as in the present invention. It is also obvious from comparison of Example 10 with Comparative Examples 28 and 29 that a high sensitivity can be attained only when the substituent Y is in an ortho position with respect to —CONH—, even if Y is electron-attractive.

Examples 12 to 40

5 g of disazo pigment corresponding to each Example in the following Table 8 was dispersed in a solution containing 2 g of butyral resin (degree of butyralization: 63% by mole) in 95 ml of ethanol in a ball mill, and then the dispersion was applied to a bonding layer by a Meile bar to form a charge generation layer having a coating amount of 0.3 g/m$^2$ after drying.

Then, the same solution for forming a charge transport layer as used in Example 1 was applied thereto by a Baker applicator to make a film thickness of 16 μm after drying. The thus prepared photosensitive member was subjected to charging measurement in the same manner as in Example 1. The charging characteristics are shown in Table 8.

TABLE 8

| Example No. | Pigment No. | $V_0$ (−V) | Vk(%) | $E_{\frac{1}{2}}$ (lux · sec) |
|---|---|---|---|---|
| 12 | 1 | 610 | 99 | 1.7 |
| 13 | 2 | 580 | 98 | 2.6 |
| 14 | 6 | 620 | 97 | 2.7 |
| 15 | 7 | 610 | 98 | 2.5 |
| 16 | 11 | 590 | 97 | 1.7 |
| 17 | 16 | 600 | 98 | 1.6 |
| 18 | 19 | 610 | 96 | 2.4 |
| 19 | 21 | 620 | 97 | 1.6 |
| 20 | 31 | 590 | 95 | 2.2 |
| 21 | 32 | 600 | 98 | 1.6 |
| 22 | 33 | 610 | 97 | 2.1 |
| 23 | 34 | 580 | 96 | 2.6 |

TABLE 8-continued

| Example No. | Pigment No. | $V_0$ (−V) | Vk(%) | $E_{\frac{1}{2}}$ (lux · sec) |
|---|---|---|---|---|
| 24 | 35 | 600 | 98 | 2.4 |
| 25 | 41 | 610 | 98 | 1.7 |
| 26 | 42 | 590 | 97 | 2.1 |
| 27 | 45 | 580 | 94 | 1.9 |
| 28 | 46 | 610 | 98 | 1.5 |
| 29 | 49 | 580 | 98 | 2.4 |
| 30 | 52 | 570 | 97 | 2.6 |
| 31 | 54 | 610 | 98 | 1.8 |
| 32 | 56 | 620 | 97 | 1.7 |
| 33 | 58 | 600 | 97 | 1.6 |
| 34 | 61 | 580 | 98 | 2.4 |
| 35 | 63 | 590 | 97 | 2.2 |
| 36 | 68 | 610 | 98 | 2.9 |
| 37 | 69 | 630 | 97 | 1.8 |
| 38 | 73 | 600 | 96 | 3.0 |
| 39 | 74 | 590 | 97 | 2.6 |
| 40 | 75 | 610 | 98 | 2.8 |
| 41 | 77 | 600 | 98 | 1.7 |

Example 42

5 g of 2,4,7-trinitrofluorenone and 5 g of polymethylmethacrylate resin (number average molecular weight: 50,000) were dissolved in 70 ml of tetrahydrofuran and the solution was applied to the same charge generation layer as prepared in Example 1 to make a coating amount of 12 g/m$^2$ after drying. The thus prepared photosensitive member was subjected to charging measurement. Its characteristics are as follows, where the charging polarity was Δ.

$V_0\oplus$; 590 V $E_{\frac{1}{2}}$; 3.2 lux·sec

Example 43

An aqueous ammoniacal solution of casein was applied to an aluminum plate having a thickness of 100 μm to form a bonding layer having a coating amount of 1.0 g/m$^2$.

Then, 5 g of 2-(4-N,N-diethylaminophenyl)-4-(4-N,N-diemthyl-aminophenyl)-5-(2-chlorophenyl)oxazole and 5 g of poly-N-vinylcarbazole (number average molecular weight: 30 g) were dissolved in 70 ml of tetrahydrofuran, and then 1.0 g of pigment No. 16, as used in Example 1, was dispersed in the resulting solution. The dispersion was applied to the bonding layer and dried to make a film thickness of 12 μm.

The thus prepared photosensitive member was subjected to charging measurement in the same manner as in Example 1. The measurements are as follows, where the charging polarity was ⊕.

V; +585 V $E_{\frac{1}{2}}$; 3.3 lux·sec

Example 44

5 g of 1-phenyl-3-(4-N,N-diethylaminostyryl)-5-(4-N,N-diethylaminophenyl)pyrazoline and 5 g of poly-2,2-propane-bis-(4-phenylisophthalic acid-terephthalic acid coester) (molar ratio of isophthalic acid to terephthalic acid = 1:1) were dissolved in 70 ml of tetrahydrofuran, and then 1.0 g of pigment No. 1, as used in Example 12, was dispersed in the resulting solution. The dispersion was applied to the same bonding layer as used in Example 12 and dried to make a film thickness of 15 μm.

The thus prepared photosensitive member was subjected to charging measurement in the same manner as in Example 12, and the measurements are as follows, where the charging polarity was ⊕.

$V_0$; ⊕600 V $E_{\frac{1}{2}}$; 2.8 lux·sec

Examples 45 to 50

5 g of pigment No. 60 as used in Example 10 was dispersed in a solution containing 2 g of butyral resin (degree of butyralization: 63% by mole) in 95 ml of ethanol, and the solution was applied to the aluminum surface of an aluminum vapor-deposited mylar film to make a coating amount of 0.2 g/m² after drying. Then, 5 g of a charge-transporting material shown in Table 9 and 5 g of phenoxy resin (Bakelite PKHH, made by UCC, USA) were dissolved in 70 ml of tetrahydrofuran, and the solution was applied to the charge generation layer and dried to form a charge transport layer having a coating amount of 11 g/m².

The thus prepared photosensitive members were subjected to charging measurement in the same manner as in Example 1, and their characteristics are shown in Table 10.

TABLE 10

| Charge-transporting material<br>Structure of charge-transporting material | Example No. | Charging measurement<br>$V_0$ (−V) | Vk (%) | $E_{\frac{1}{2}}$ (lux · sec) |
|---|---|---|---|---|
| 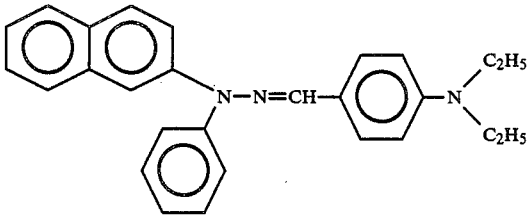 | 45 | 600 | 97 | 2.0 |
| 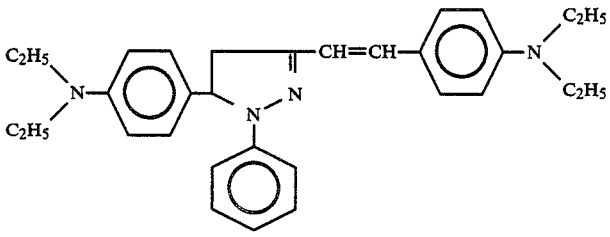 | 46 | 610 | 98 | 2.6 |
| 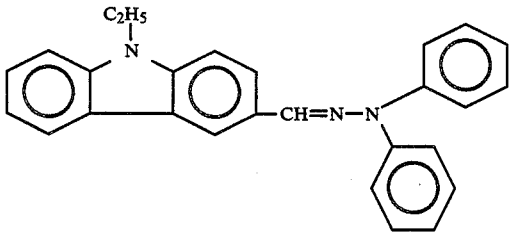 | 47 | 610 | 97 | 2.8 |
| 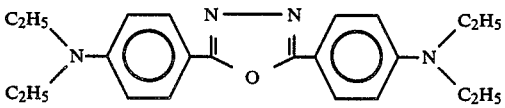 | 48 | 605 | 96 | 2.8 |
| 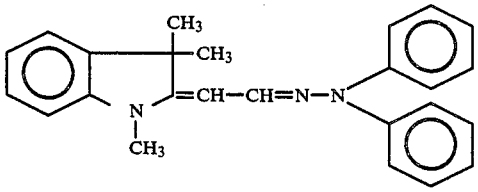 | 49 | 600 | 97 | 2.1 |

TABLE 10-continued

| Charge-transporting material<br>Structure of charge-transporting material | Example No. | Charging measurement<br>$V_0$ (−V) | Vk (%) | $E_{\frac{1}{2}}$ (lux · sec) |
|---|---|---|---|---|
| 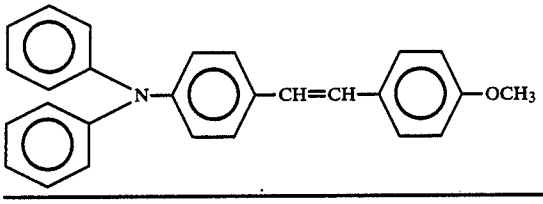 | 50 | 580 | 98 | 2.4 |

Example 51

A charge transport layer and a charge generation layer were laminated in this order on a bonding layer on an aluminum plate provided with the bonding layer, as used in Example 1, with the same coating solutions as used in Example 1, respectively to prepare a photosensitive member having a charge transport layer having the thickness of 16 μm and the charge generation layer having a coating amount of 0.3 g/m$^2$ in the same manner as in Example 1. The thus prepared photosensitive member was subjected to charging measurement in the same manner as in Example 1, except that the charging polarity was ⊕. The charging characteristics are shown in Table 11.

TABLE 11

| $V_0$ (−V) | Vk(%) | $E_{\frac{1}{2}}$(lux · sec) |
|---|---|---|
| 580 | 96 | 2.0 |

Example 52 to 56

The photosensitive members used in Examples 1 to 5 were subjected to fluctuation measurement of light portion potential and dark portion potential, when used repeatedly by pasting the photosensitive member onto a cylinder in an electrophotographic copying machine comprising a corona charger at −5.6 kV, a light exposure optical system, a developer, a transfer charger, a deelectrifying light exposure optical system and a cleaner. The copying machine led such a function to produce an image on a transfer sheet as the cylinder is driven. The initial light portion potential ($V_L$) and dark portion potential ($V_D$) were set to about −100 V and about −600 V, respectively, in the copying machine, and the light portion potential ($V_L$) and dark portion potential ($V_D$) after 5,000 repetitions were measured. The results are shown in Table 12.

TABLE 12

| Example No. | Photosensitive member | Initial<br>$V_D$ (−V) | $V_L$ (−V) | After 5,000 repetitions<br>$V_D$ (−V) | $V_L$ (−V) |
|---|---|---|---|---|---|
| 52 | Same as in Example 1 | 600 | 100 | 620 | 130 |
| 53 | Same as in Example 2 | 590 | 100 | 610 | 110 |
| 54 | Same as in Example 3 | 590 | 110 | 600 | 130 |
| 55 | Same as in Example 4 | 600 | 90 | 630 | 120 |
| 56 | Same as in Example 5 | 610 | 100 | 620 | 120 |

According to the preent invention, either carrier generation efficiency or carrier transport efficiency within the photosensitive layer, or both can be improved by using a specific azo pigment in the photosensitive layer, and a photosensitive member having a distinguished sensitivity and a distinguished potential stability when continuously used can be obtained.

We claim:

1. An electrophotographic photosensitive member comprising a photosensitive layer on a support, said photosensitive layer containing (a) a disazo pigment represented by the following general formula [I]:

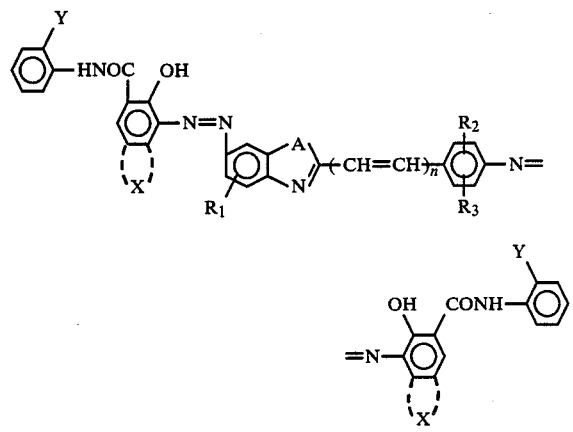

wherein X represents a necessary residue for forming a polycyclic aromatic ring or a hetero ring which may have a substituent by condensation with a benzene ring; Y represents an electron attractive group; A represents —O—, —S—, or $$-\underset{\underset{R_4}{|}}{N}-,$$

where $R_4$ represents a hydrogen atom, alkyl, aralkyl or aryl which may have a substituent; $R_1$, $R_2$ and $R_3$ each represent a hydrogen atom, a halogen atom, alkyl or alkoxy group which may have a substituent; and n is 0 or 1, and (b) optionally, a binder resin.

2. An electrophotographic photosensitive member according to claim 1, wherein the photosensitive layer is a photosensitive layer of monolayer structure.

3. An electrophotographic photosensitive member according to claim 1 wherein the photosensitive layer is a photosensitive layer of laminated structure having a charge generation layer and a charge transport layer, and the charge generation layer contains the disazo pigment of the general formula (I).
4. An electrophotographic photosensitive member according to any one of claims 1 to 3, wherein the disazo pigment is selected from pigments having the following structural formulae (a) to (f).
(a)
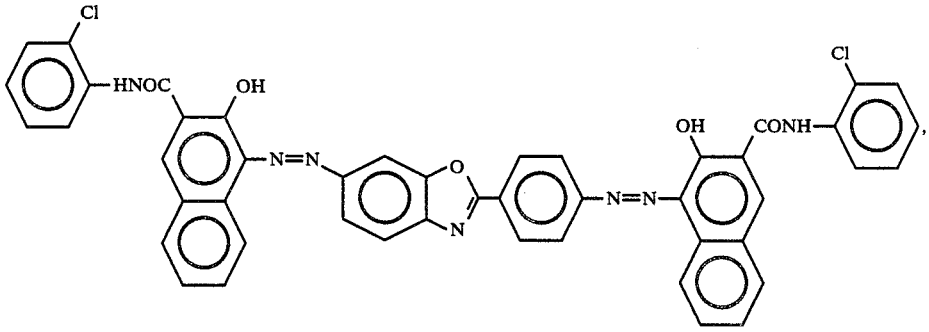
(b)
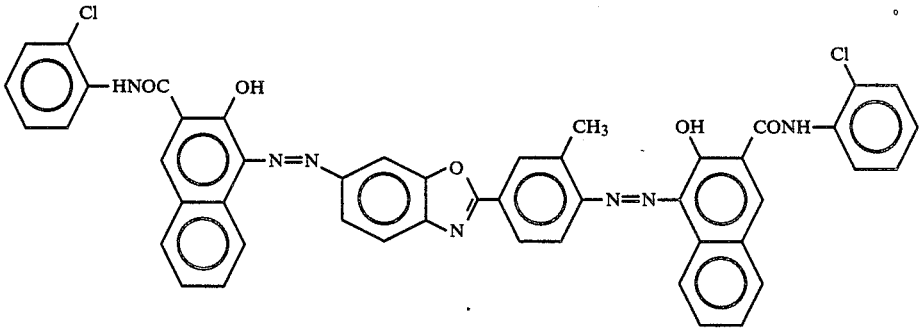
(c)
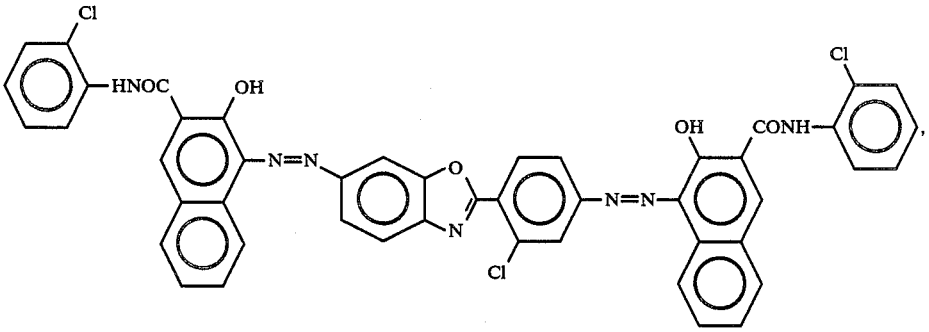
(d)
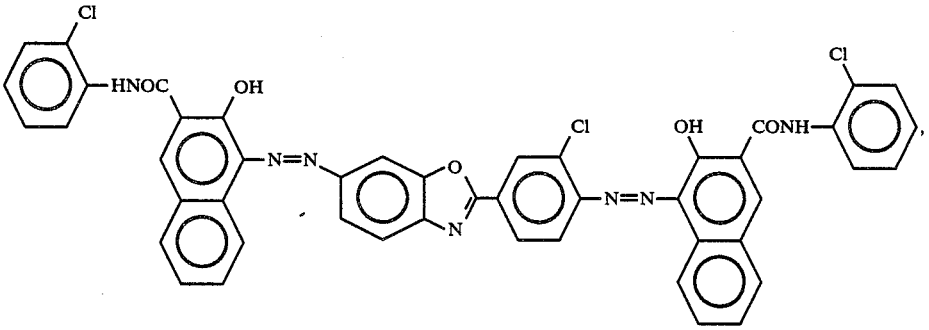

-continued (e)

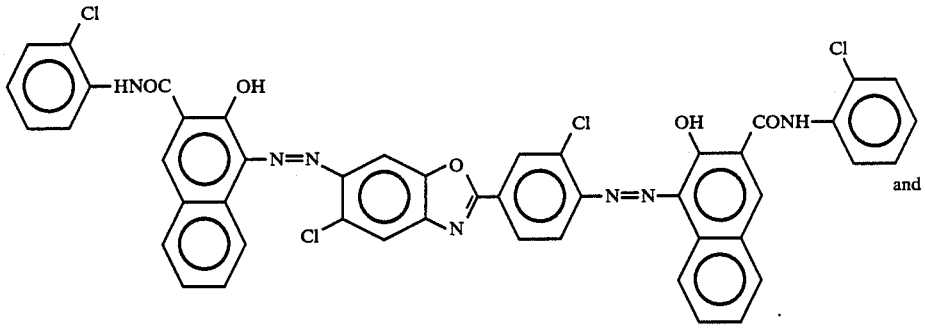

and (f)

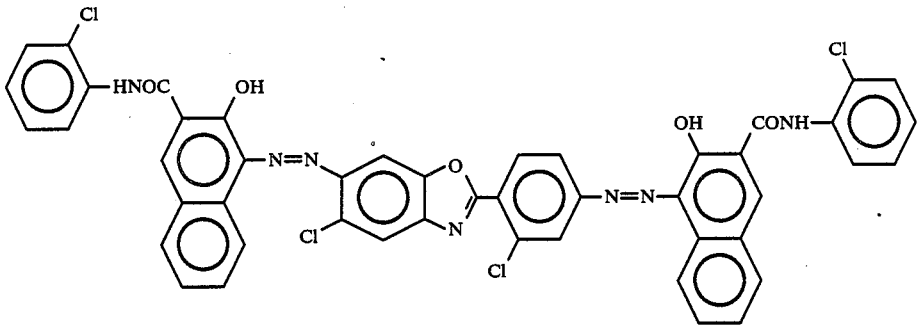

5. An electrophotographic photosensitive member according to claim 4, wherein the charge generation layer and the charge transport layer are provided in this order from the side near the support.

6. An electrophotographic photosensitive member according to claim 4, wherein the charge transport layer and the charge generation layer are provided in this order from the side near the support.

7. An electrophotographic photosensitive member according to claim 1, wherein Y is selected from the group consisting of halogen, nitro, cyano, trifluoromethyl or actyl.

* * * * *

UNITED STATES PATENT AND TRADEMARK OFFICE

CERTIFICATE OF CORRECTION

PATENT NO. : 4,788,119

DATED : November 29, 1988

INVENTOR(S) : MASATAKA YAMASHITA, ET AL.

It is certified that error appears in the above-identified patent and that said Letters Patent is hereby corrected as shown below:

COLUMN 2

Line 13, "an" should read --a--.

COLUMN 32

Line 2, "$cm^{-}$." should read --$cm^{-1}$.--

COLUMN 50

Line 52, "was Δ" should read --was ⊕.--
Line 62, "N,N-diemthyl" should read --N,N-dimethyl--.

COLUMN 51

Line 5, "V; +585 V" should read --Vo; +585 V--.

COLUMN 58

Line 34, "actyl." should read -- acetyl --.

Signed and Sealed this

Nineteenth Day of December, 1989

*Attest:*

JEFFREY M. SAMUELS

*Attesting Officer* *Acting Commissioner of Patents and Trademarks*